US010043617B2

(12) United States Patent
Simard et al.

(10) Patent No.: US 10,043,617 B2
(45) Date of Patent: Aug. 7, 2018

(54) LOCKING SYSTEM FOR POWER LINE SECTIONING UNIT

(71) Applicant: MOVEX INNOVATION INC., Shawinigan (CA)

(72) Inventors: Martin Simard, Saint-Tite (CA); Marc-Andre Lefebvre, Trois-Rivieres (CA); Fabien Lavoie, Grand-Mere (CA); Mario Gauthier, Shawinigan (CA)

(73) Assignee: MOVEX INNOVATION INC., Shawinigan (CA)

( * ) Notice: Subject to any disclaimer, the term of this patent is extended or adjusted under 35 U.S.C. 154(b) by 164 days.

(21) Appl. No.: 14/693,452

(22) Filed: Apr. 22, 2015

(65) Prior Publication Data

US 2015/0325388 A1 Nov. 12, 2015

Related U.S. Application Data

(60) Provisional application No. 61/982,563, filed on Apr. 22, 2014.

(51) Int. Cl.
*H01H 9/28* (2006.01)
*H01H 31/28* (2006.01)
(Continued)

(52) U.S. Cl.
CPC ..... *H01H 9/28* (2013.01); *H01H 31/28* (2013.01); *H01H 9/18* (2013.01); *H01H 31/06* (2013.01); *H01H 2219/036* (2013.01)

(58) Field of Classification Search
CPC ..... H01H 9/28; H01H 31/28; H01H 31/06; H01H 9/18; H01H 2219/036
(Continued)

(56) References Cited

U.S. PATENT DOCUMENTS 5,268,543 A * 12/1993 Ramos ..... H01H 9/28 200/43.01
5,823,321 A * 10/1998 Leclerc ..... H01H 9/286 200/43.01
(Continued)

FOREIGN PATENT DOCUMENTS

CA 2701235 10/2010
CA 2824844 7/2012

*Primary Examiner* — Edwin A. Leon
*Assistant Examiner* — Lheiren Mae A Caroc
(74) *Attorney, Agent, or Firm* — Norton Rose Fulbright Canada LLP

(57) ABSTRACT

A locking system for a disconnect switch mounted to a utility pole. The locking system includes an attachment assembly mounted to the disconnect switch. The attachment assembly has an attachment body with a groove, and a locking arm disposed within the groove and pivotable between an open configuration and a locked configuration. A trigger mechanism extends through the locking arm and selectively secures the locking arm in the locked configuration. The locking system also has a lock assembly mounted to the attachment assembly, which has a lock body defining a central aperture for receiving a key therein. The lock assembly has a rotatable cam disposed at an end of the central aperture. The cam engages the key upon being rotated thereby. When it rotates, the cam engages the trigger mechanism to selectively secure the locking arm in the locked configuration.

18 Claims, 22 Drawing Sheets

(51) Int. Cl.
*H01H 9/18* (2006.01)
*H01H 31/06* (2006.01)

(58) Field of Classification Search
USPC ..... 200/43.04, 43.08, 43.11
See application file for complete search history.

(56) References Cited

U.S. PATENT DOCUMENTS 8,247,715 B2 * 8/2012 Yu ..... H01H 9/283
200/43.11
8,829,372 B1 * 9/2014 Rhein ..... H01H 31/28
200/48 SB

* cited by examiner

LOCKING SYSTEM FOR POWER LINE SECTIONING UNIT

CROSS-REFERENCE TO RELATED APPLICATION

The application relates claims priority on U.S. Provisional Application Ser. No. 61/982,563, filed on Apr. 22, 2014.

TECHNICAL FIELD

The application relates generally to locks and, more particularly, to a locking system for power line switches.

BACKGROUND OF THE ART

It is sometimes required to perform maintenance or inspect utility poles and their components. When the utility pole being worked on supports overhead power lines, it is sometimes necessary to disable the power lines so that the work can be performed safely.

Such utility poles therefore have one or more disconnectors, which are used to ensure that an electrical circuit, for instance in a branch of a power network, is completely de-energised for service or maintenance. The disconnectors can be operated either manually, or can be motorized. Typically, disconnectors are known as "off-load devices" because they are opened only after current has been interrupted by some other control device. Disconnectors generally employ safety devices to prevent inadvertent operation. Some may require a key or similar failsafe, to confirm that the technician actually intends to activate it.

Some safety devices for disconnectors require that the technician be raised to the height of the disconnector in order to attach the safety device, which can be time consuming and potentially hazardous. Furthermore, some safety devices are not easily attached to the disconnector, or require complex locking mechanisms to prevent use of the disconnector.

SUMMARY

In one aspect, there is provided a locking system for a disconnect switch portion mounted to a utility pole, the locking system comprising: an attachment assembly mountable to the disconnect switch portion, the attachment assembly having an attachment body defining a groove extending into the attachment body, a locking arm disposed within the groove and pivotable about a pivot shaft extending between opposed interior surfaces of the groove, the locking arm pivotable between an open configuration and a locked configuration, and a trigger mechanism extending through the locking arm and selectively securing the locking arm in the locked configuration; and a lock assembly mounted to the attachment assembly and having a lock body defining a central aperture for receiving a key therein, the lock assembly having a rotatable cam disposed at an end of the central aperture within the lock body, the cam being engaged by the key and rotated thereby, a rotation of the cam engaging the trigger mechanism to selectively secure the locking arm in the locked configuration.

In another aspect, there is provided a locking system for preventing movement of a connecting bar between disconnect switch portions of a utility pole, the locking system comprising: an attachment assembly having an attachment body mountable to the disconnect switch portion, and a locking arm connected to the attachment body and pivotable relative thereto between an open configuration and a locked configuration, the locking arm in the locked configuration engaging the connecting bar and blocking movement thereof between the disconnect switch portions; and a lock assembly mounted to the attachment assembly and having a lock body defining an aperture for receiving a key therein, the lock assembly having a rotatable cam disposed at an end of the aperture within the lock body, the cam being engaged by the key and rotated thereby, a rotation of the cam selectively securing the locking arm in the locked configuration.

In yet another aspect, there is provided a method of preventing movement of a connecting bar between disconnect switch portions of a utility pole, comprising: engaging an end of one of the disconnect switch portions with a locking system; locking the locking system to the end of said disconnect switch portion; and preventing removal of the locking system from the end of said disconnect switch portion until the locking system is unlocked.

DESCRIPTION OF THE DRAWINGS

Reference is now made to the accompanying figures in which.

DETAILED DESCRIPTION

Figure 1A:
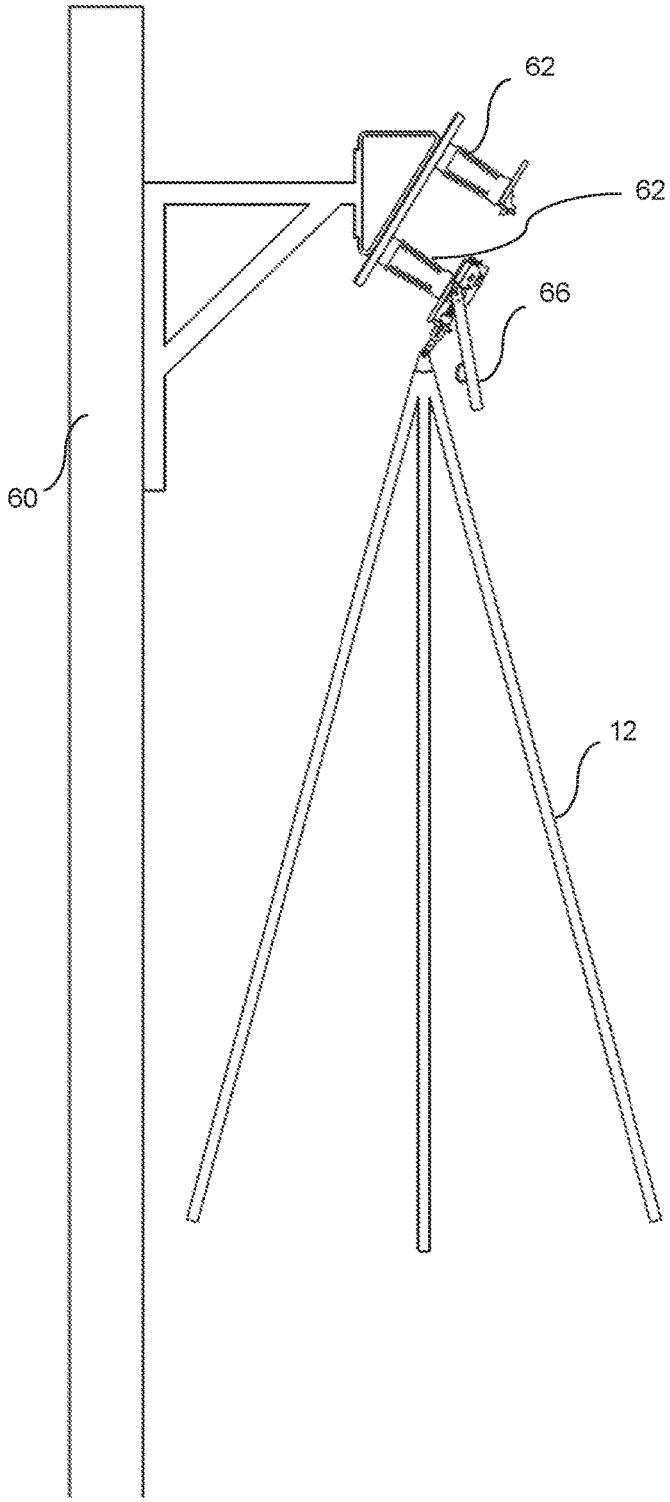
FIG. 1A is a side view of a utility pole with two disconnect switches and a locking system shown secured to one of the disconnect switches, according to an embodiment of the present disclosure.
Figure 1B:
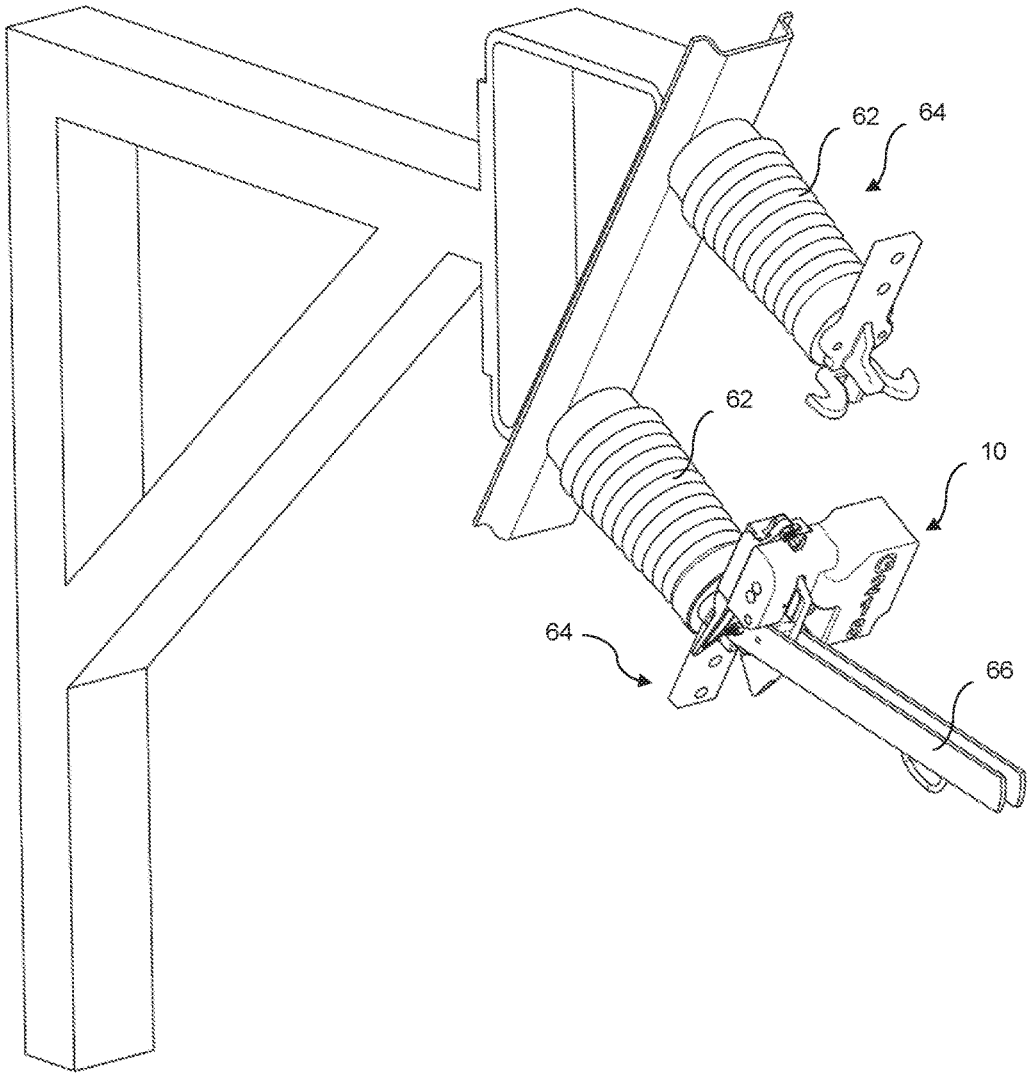
FIG. 1B is an enlarged view of the circled portion of FIG. 1A.
Figure 1C:
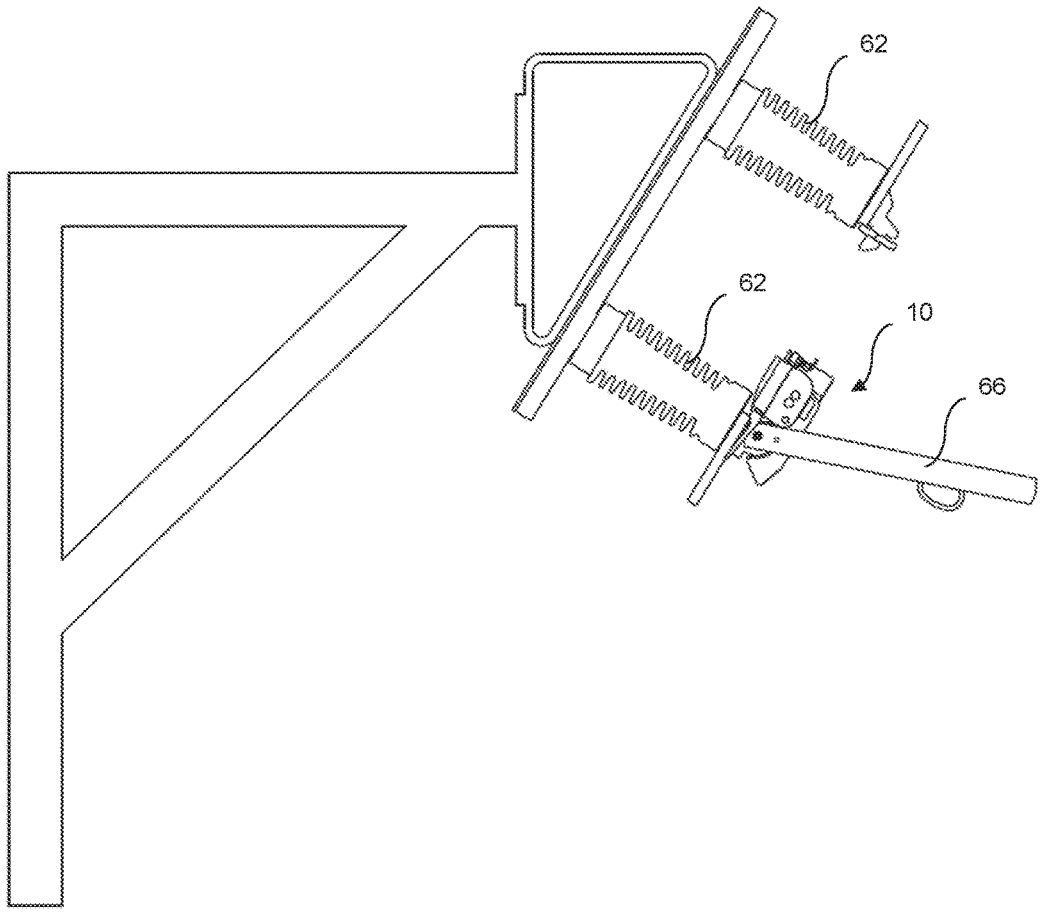
FIG. 1C is a side view of the locking system of FIG. 1A secured to one of the disconnect switches, and shown preventing rotational displacement of a connecting bar.

FIGS. 1A to 1C illustrate a utility pole 60 used for supporting electrical power lines, among other possible cables and wires. The utility pole 60 has one or more disconnect switch portions 62 which are mounted to the utility pole 60 by any suitable support bracket or technique. The disconnect switch portions 62 are used to de-energise the power lines, thereby allowing technicians and service crews to work on the power lines and/or utility poles without risk of injury. As such, each disconnect switch portion 62 can be a disconnector, an isolator switch, or any other suitable device capable of the functionality ascribed to it herein. With the particular disconnect switch portions 62 shown in FIGS. 1A to 1C, the power lines can be re-energised when a pivoting connecting bar 66 links the two disconnect switch portions 62 shown, to close the circuit and enable power circulation.

In order to prevent an accidental or inadvertent re-energising of the power lines, a locking system 10 is employed and secured to one or more of the disconnect switch portions 62 at each of their ends 64, to block the pivoting movement of the connecting bar 66. When so secured, and as shown in FIG. 1C, the locking system 10 of this particular embodiment prevents the rotational displacement of the connecting bar 66 past a certain point, such that it is physically impossible for it to contact the other disconnect switch portion 62. When secured in place, the locking system 10 therefore makes it impossible to re-energise the power line with the connecting bar 66, until such time as the locking system 10 is removed. It is appreciated that the locking system 10 disclosed herein does not need to necessarily restrict the movement of a connecting bar 66, and may act on other components of the disconnect switch portion 62 and/or power line, provided that when it is secured thereto, the locking system 10 prevents the re-energising of the power line. When the locking system 10 is attached from the ground by the technician, a pole 12 may be used to mount and secure the locking system 10 from a distal position, such as from the ground.

Figure 2A:
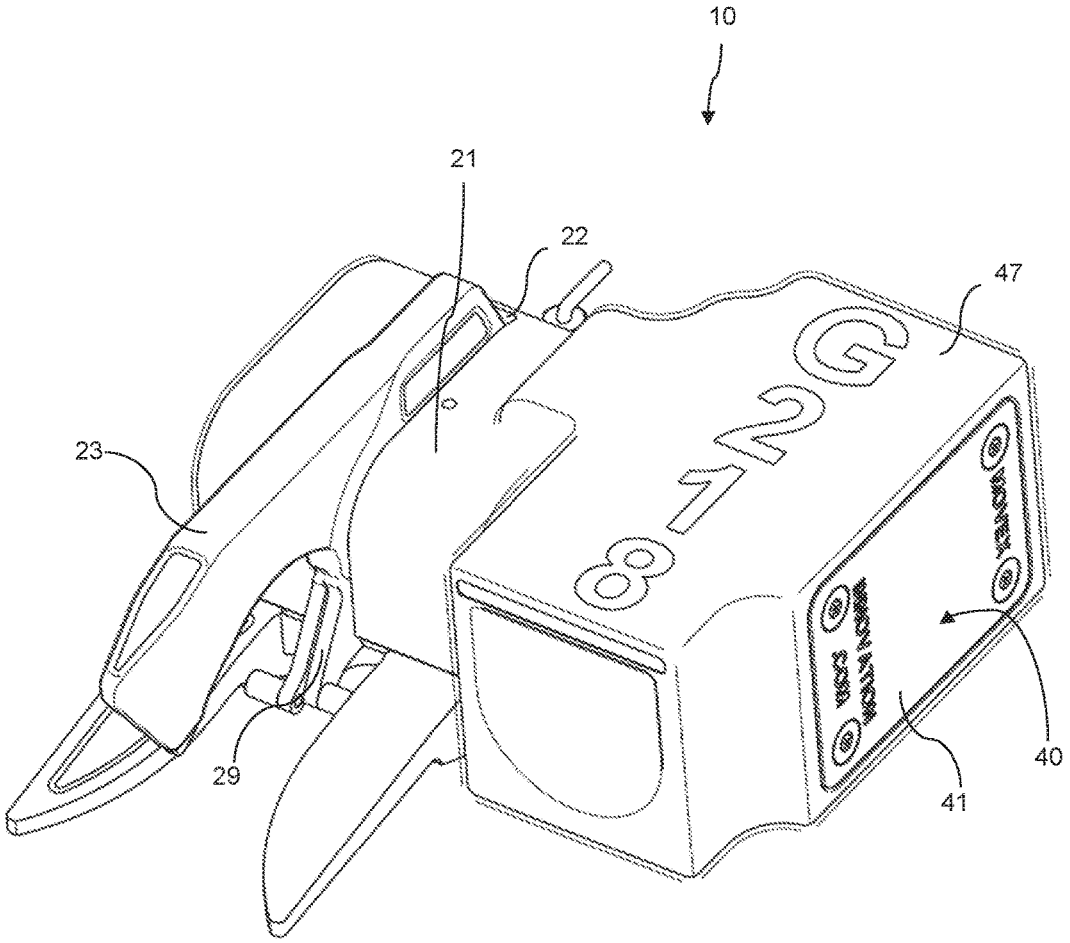
FIG. 2A is a perspective view of the locking system of FIG. 1A having an attachment assembly and a lock assembly.
Figure 2B:
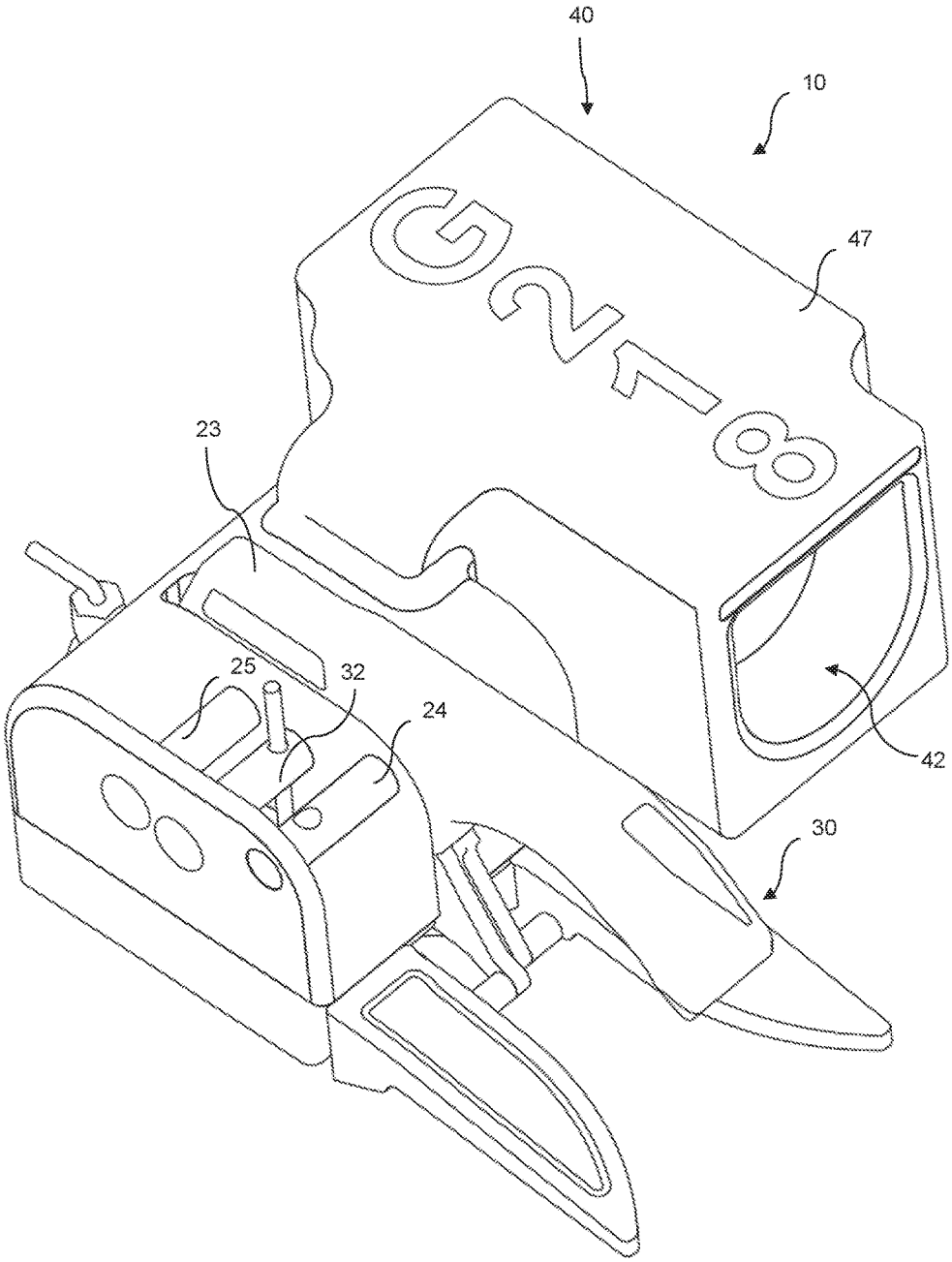
FIG. 2B is a perspective transparent view of the locking system of FIG. 1A, a locking arm of the attachment assembly being shown in an open configuration.
Figure 2C:
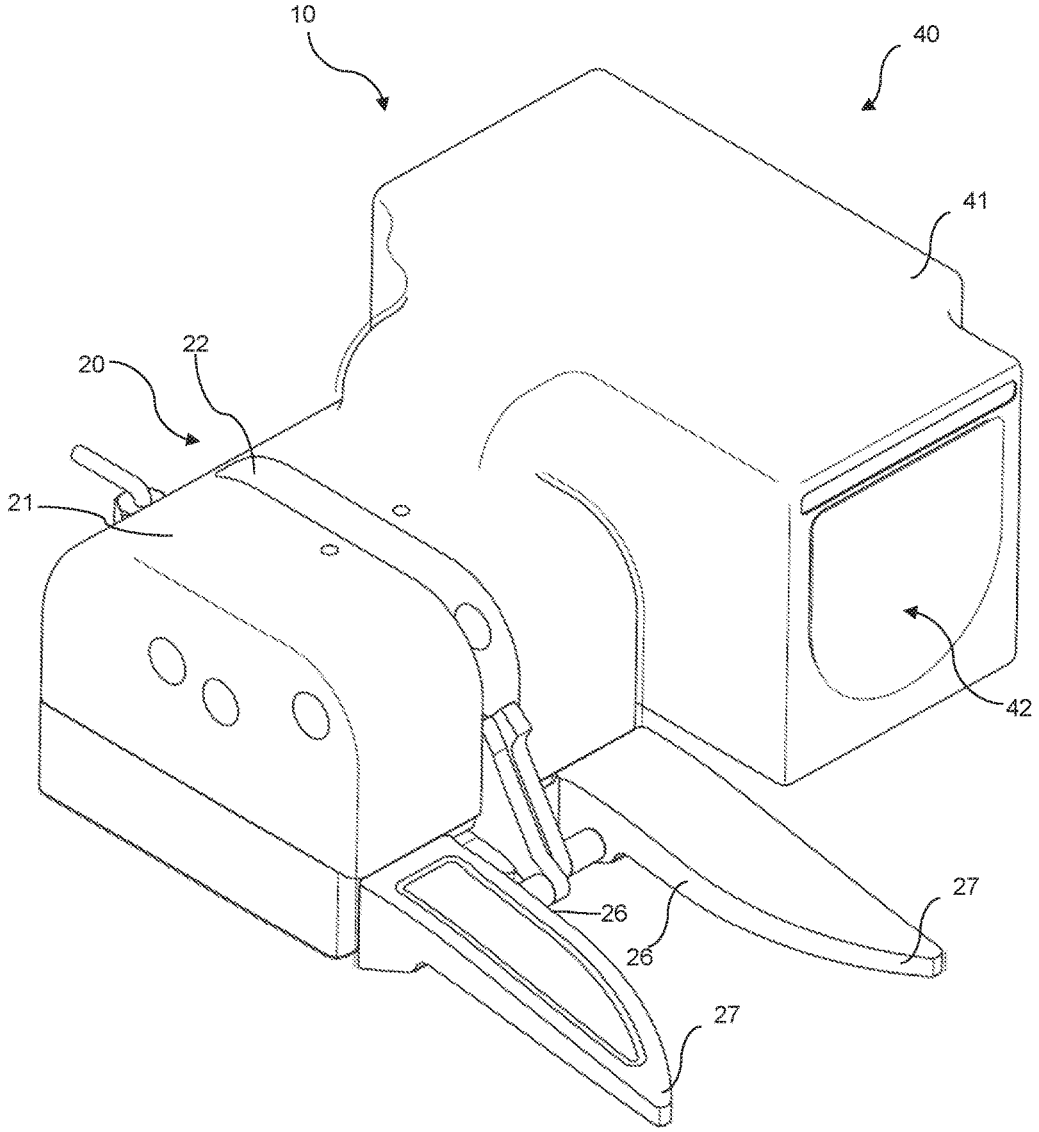
FIG. 2C is a perspective view of a locking system having a light-emitting diode, according to another embodiment of the present disclosure.

Referring to FIGS. 2A to 2C, the locking system 10 disclosed herein has an attachment assembly 20 which mounts to the end of the disconnect switch portion, and a lock assembly 40 which secures the locking system 10 to the disconnect switch portion. Both the attachment assembly 20 and the lock assembly 40 are now described in greater detail.

The attachment assembly 20 is the portion of the locking system 10 which is mounted to the pivot of the connecting bar 66 and to the end of the disconnect switch portion 62, and which is secured thereto. As such, the attachment assembly 20 can take many different shapes and configurations to accomplish such functionality. The attachment assembly 20 has an attachment body 21 having a groove 22 therein, a locking arm 23, and a trigger mechanism 25, all of which are now described in greater detail.

The attachment body 21 forms the corpus of the attachment assembly 20 and provides structure thereto. It can thus take many shapes that differ from the one shown, and which can be determined based on the following non-exhaustive list of factors: the corresponding shape of the disconnect switch portion to which the locking system 10 will be mounted, the distance of the disconnect switch from the technician, the inertial resistance that the attachment body 21 must supply to resist the movement of components of the disconnect switch portion, etc.

Irrespective of its shape, the attachment body 21 has a groove 22 formed therein. Although shown as being centrally located within the attachment body 21, the groove 22 can be located elsewhere provided that it can receive the locking arm 23 therein and allow it to pivot. Similarly, the depth at which the groove 22 extends within the attachment body 21 can vary depending on the locking arm 23 disposed therein. The groove 22 has opposed internal surfaces which are spaced apart from one another and define the interior of the groove 22.

The locking arm 23 engages the end of the disconnect switch portion 62 and connecting bar 66 and is secured thereto, thereby securing the locking system 10 to the disconnect switch portion 62 and connecting bar 66. The locking arm 23 can therefore take many different configurations in order to achieve such functionality. In FIGS. 2A and 2B, the locking arm 23 has a mounting end 30 which engages the end of the disconnect switch. The mounting end 30 shown has an arcuate receiving surface 29 which can smoothen contact between the locking arm 23 and the disconnect switch portion 62 and connecting bar 66 when these components are in the process of being engaged to one another. The mounting end 30 can have other shapes depending upon the corresponding shape of the end of the disconnect switch portion or connecting bar with which it will engage.

The locking arm 23 is positioned within the groove 22, and is pivotable about a pivot shaft 24. The pivot shaft 24 extends between the two opposed interior surfaces of the groove 22. The locking arm 23 pivots between an open configuration, in which the locking arm 23 can be attached to the end of the disconnect switch portion 62, and a locked or closed configuration, in which the locking arm 23 is secured in place on the end of the disconnect switch portion 62, about the pivot of the connecting bar 66. The pivoting movement of the locking arm 23 within the groove 22 can be restricted or limited by a movement limiter 32.

The trigger mechanism 25 engages the locking arm 23 and selectively blocks it from pivoting between the open and locked configurations. In the embodiment shown in FIGS. 2A and 2B, the trigger mechanism 25 extends through the locking arm 23. The trigger mechanism 25 has a biasing means such as a spring 34, which biases the trigger mechanism 25 towards the locking arm 23. The spring 34 on the other side of the locking arm 34 has an indexing ball, that is used to keep the locking arm 23 in the open configuration. When the locking arm 23 is in the open configuration by default, as shown in FIGS. 2A and 2B, a selective action is required by the technician to move the locking arm 23 into the locked configuration and secure it in said configuration, by abutment with the pivot at the end of the switch portion 62. The displacement of the trigger mechanism 25 toward and away from the locking arm 23 can be accomplished with a rotatable cam, which is further discussed below.

In some embodiments, an example of which is shown in FIG. 2C, the attachment assembly 20 can have one or more guide arms 26 which extend away from a surface of the attachment body 21. The guide arms 26 help guide the attachment body 21, and thus the locking system 10, onto the end of the disconnect switch 62, and hook onto the pivot projecting from opposite sides of the connecting bar 66. The locking arm 23 can pivot between the guide arms 26. The free or receiving end 27 of each guide arm 26 can be shaped to facilitate the mounting of the attachment body 21 to the end 64 of the disconnect switch portion 62. For example, the guide arms 26 at their receiving ends 27 can each extend away from each other, or having inclined portions extending away from each other, thereby widening the space between the receiving ends 27 and facilitating the mounting of the attachment body 21 to the end of the disconnect switch. As will be discussed in greater detail below, the guide arms 26 can be removably attached from the attachment body 21. This allows the technician to replace the guide arms 26 when desired, so as to allow the attachment assembly 20 to be mounted onto disconnect switches having different shapes and configurations, as the guide arms 26 are interfaced to the disconnect switch portion 62/connecting bar 66 as mentioned above. Further optionally, the attachment body 21 can have one or more light sources, such as a light-emitting diode (LED) 28, which can illuminate the position of the end of the disconnect switch, thereby helping the technician to view where the attachment body 21 must be mounted. This can be particularly advantageous in situations where the technician is positioned far away from the disconnect switch, or when the technician attaches the locking system 10 to the disconnect switch in low-light situations.

Still referring to FIGS. 2A to 2C, the locking system 10 also has a lock assembly 40. The lock assembly 40 is connected to the attachment assembly 20, and secures the locking system 10 to the end 64 of the disconnect switch portion 62. More specifically, the lock assembly 40 secures the locking arm 23 in the locked configuration. The lock assembly 40 has a lock body in which a lock plate 41 having a central aperture 41A is received and moves in translation. A rotatable cam 44 is rotatably mounted in the lock body to a locking mechanism 50, all of which are now described in further detail.

The lock body is attached to a side of the attachment assembly 20, and houses the components of the lock assembly 40. It can thus take many different forms. The lock body contains and defines an aperture 42, which extends into the lock body and is adapted to define a passage for the lock body to receive a key displace the trigger mechanism 25. The aperture 42 can take different forms. For example, the aperture 42 has a substantially circular cross-section in FIG. 2B, and has a U-shaped cross-section in FIG. 2C. The aperture 42 can also have a conical cross-section as shown in FIG. 2B, such that the area of the cross-section decreases further into the lock body. Other shapes for the cross-section of the aperture 42 are within the scope of the present disclosure. One or more surfaces of the lock body 41 can include an alphanumeric indicator 47. The alphanumeric indicator 47 indicates to the technician the type of locking mechanism being used, and therefore, which key is required to unlock it. The alphanumeric characters of the indicator 47 can be sufficiently large so as to be seen by the technician from a distance, such as from the ground. One or more surfaces of the locking system 10 can also include a colour-coded indicator. The colour-coded indicator indicates to the technician the type of locking mechanism being used, and therefore, which key is required to unlock it. The colour-coded indicator may be used with, or instead of, the alphanumeric indicatory 47.

Figure 3A:
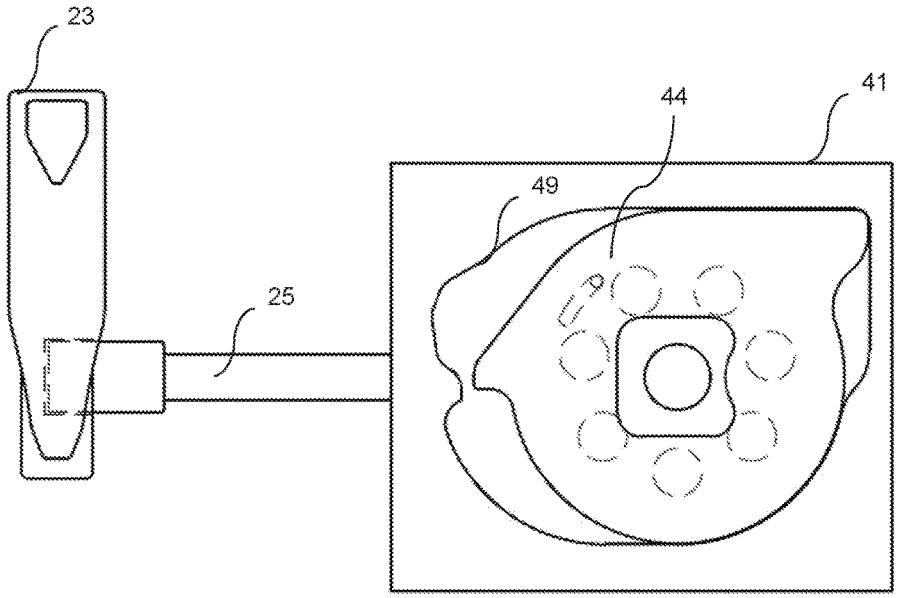
FIG. 3A is a front view of a rotatable cam, a trigger mechanism, and a locking arm, the rotatable cam being shown disengaged from the trigger mechanism; according to yet another embodiment of the present disclosure.
Figure 3B:
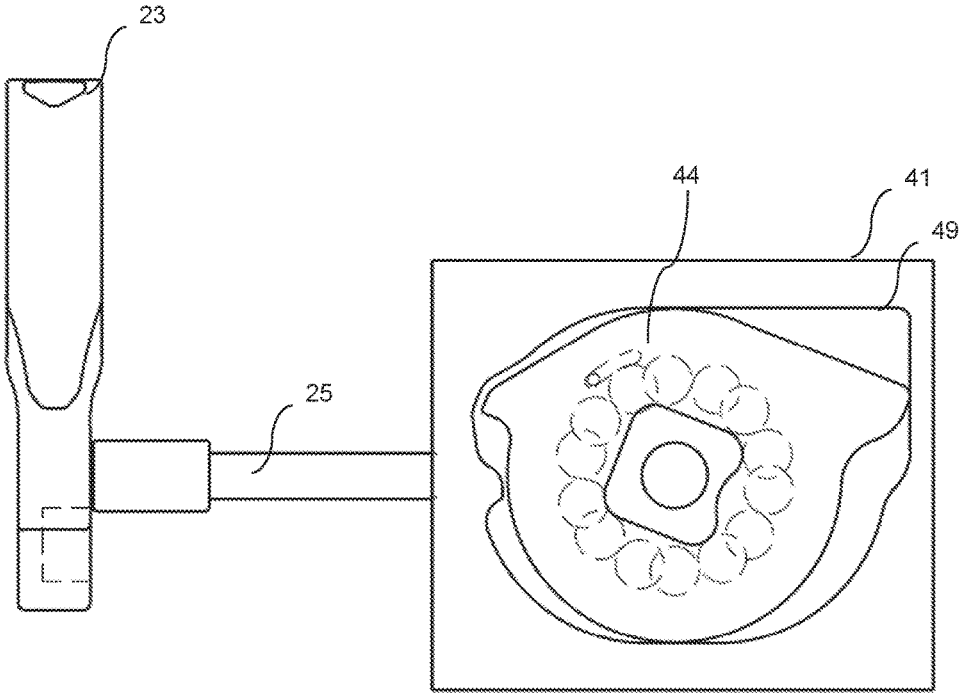
FIG. 3B is a front view of the rotatable cam of FIG. 3A after having engaged the trigger mechanism.

Referring now to FIGS. 3A and 3B, the lock body houses the rotatable cam 44. The cam 44 rotates within the lock plate 41 or a component thereof. An interior cam surface 49 defines the contact boundaries of the aperture 41A with which the cam 44 will come into contact. Because of the interior cam surface 49, the rotation of the cam 44 causes a translation displacement of the trigger mechanism 25, thereby allowing it to displace the locking arm 23 between the open and locked configurations. It will thus be appreciated that both the cam 44 and the interior cam surface 49 can take shapes different from those shown in FIGS. 3A and 3B in order to provide such functionality, and provided that the cam 44 and lock plate 41 are able to convert a rotational motion into a linear displacement of the trigger mechanism 25.

Figure 4A:
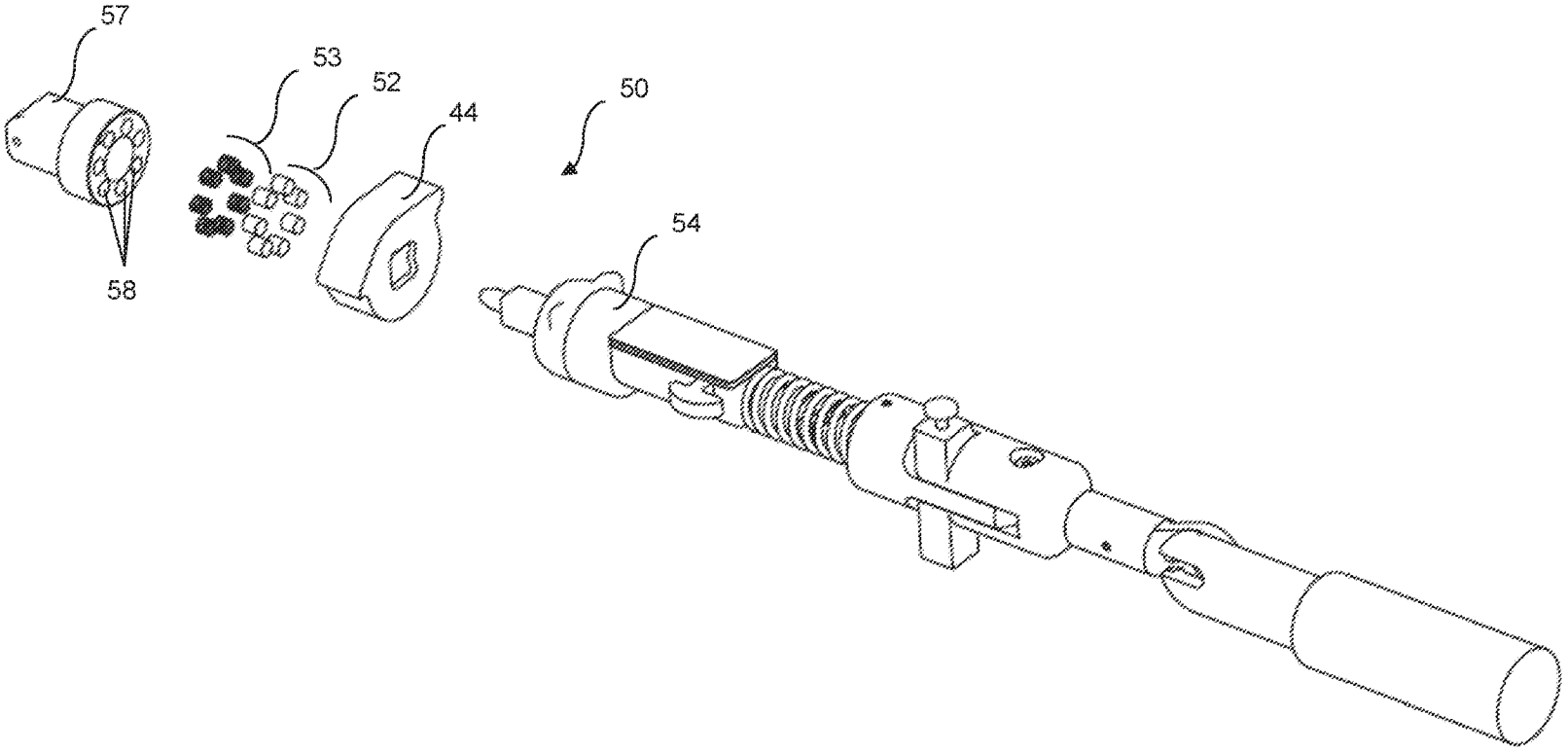
FIG. 4A is an exploded perspective view of a lock assembly having a locking mechanism, according to yet another embodiment of the present disclosure.
Figure 4B:
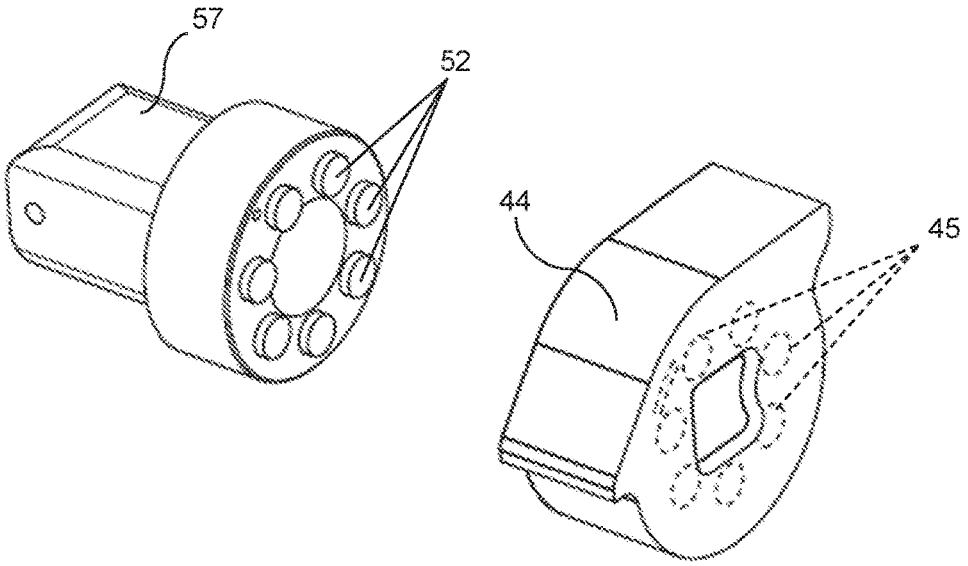
FIG. 4B shows an assembled view of the circled portion of FIG. 4A and a rotatable cam.
Figure 4C:
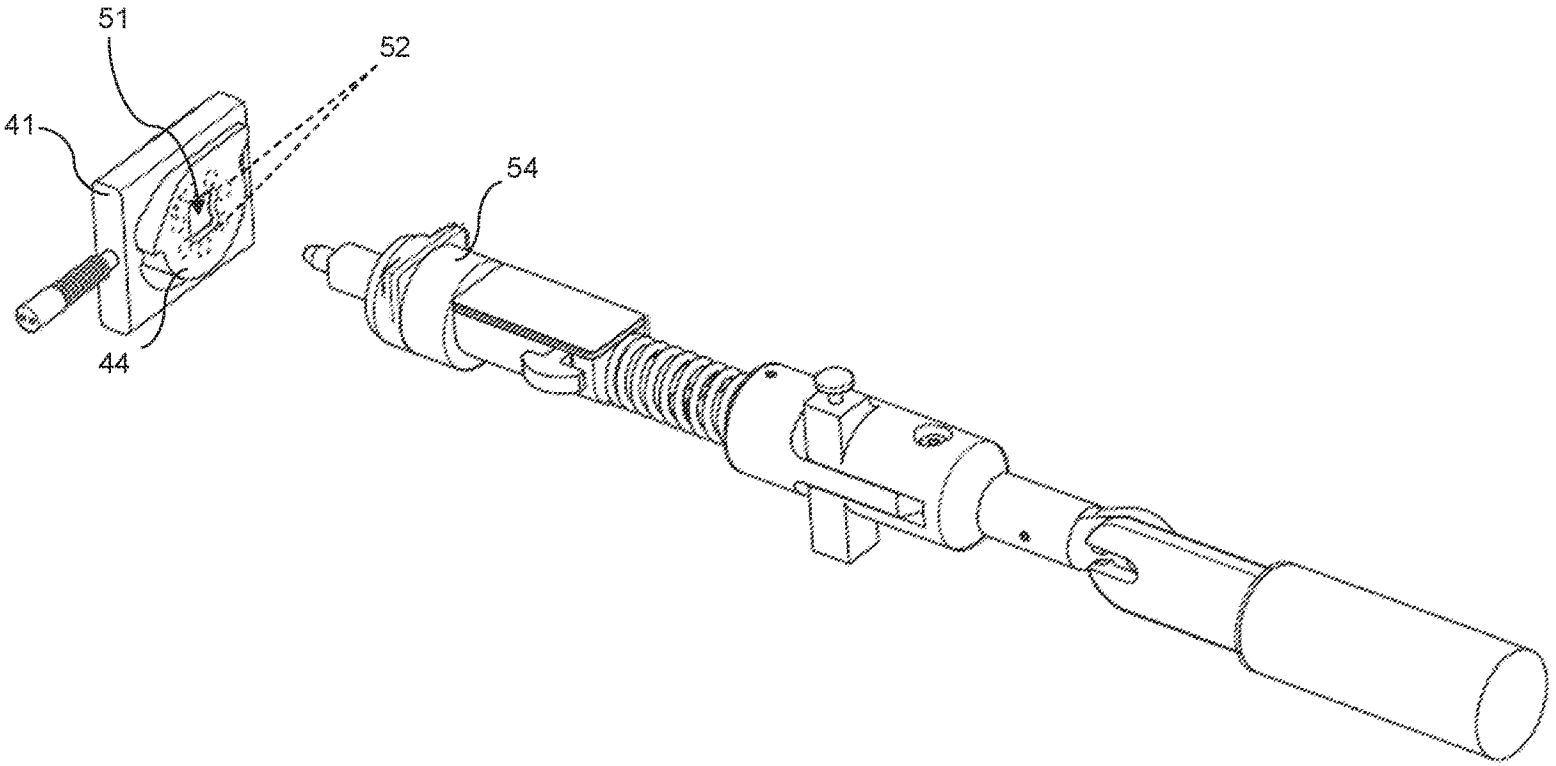
FIG. 4C is a perspective view of the key of FIG. 4A about to engage the rotatable cam.

FIGS. 4A to 4C provide an example of the locking mechanism 50. The locking mechanism 50, and specifically the cam 44, engages the trigger mechanism 25 so as to displace it between the open and locked configurations. The locking mechanism 50 includes a fixed member 57 disposed within the lock body 41, and a key 54 which rotates the cam 44.

The fixed member 57 remains stationary within the lock body 41, and has a round head upon which is rotatably mounted to the cam 44 (the cam 44 being hollow). The fixed member 57 can have multiple biasing members, such as lock springs 53, to which are attached lock magnets 52. Both the lock springs 53 and the lock magnets 52 are circumferentially spaced apart from one another along a face of the fixed member 57. The lock springs 53 are placed within corresponding lock apertures 58 in the fixed member 57, and the lock magnets 52 are placed within the same lock apertures 58 and attached on top of the lock springs 53, as shown in FIG. 4B. The lock springs 53 bias the lock magnets 52 away from the fixed member 57 and away from the lock apertures 58. The cam 44 can have similarly circumferentially-spaced cam apertures 45, such that when the cam 44 engages the fixed member 57 and is abutted thereagainst, the lock springs 53 are able to bias the lock magnets 52 away from the fixed member 57 and into the corresponding cam apertures 45, thereby preventing the cam 44 from rotating. The cam 44 is thus rendered immobile.

Figure 6:
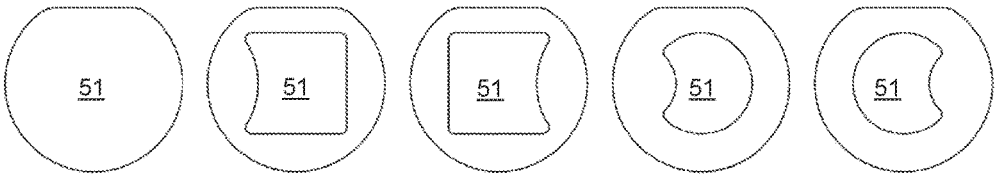
FIG. 6 is a schematic view of different key hole shapes, according to yet another embodiment of the present disclosure.

The key 54 can engage and rotate the cam 44, thereby rendering it mobile or immobile, as desired. In the embodiment shown in FIGS. 4A to 4C, the key 54 itself has key magnets 56 circumferentially spaced apart along one of its faces and disposed in corresponding apertures. If so required, the cam 44 can have a key hole 51, which receives therein a correspondingly-shaped projection from the key 54, in such a way that a single orientation of penetration is possible. The key hole 51 and matching projection of the key 54 advantageously allow the technician, via the key 54, to apply greater torque to rotate the cam 44 while minimising slip between the key 54 and the cam 44. Some of the many possible shapes for the key hole 51, and therefore of the correspondingly-shaped projection of the key 54, are shown in FIG. 6. As discussed in greater detail below, the key 54 can be removably connected to the pole or some other mounting. This allows different keys to be attached to, and removed from, the end of the pole so that a single pole can be used for locking systems 10 requiring various keys 54.

Returning to FIGS. 4A to 4C, one possible engagement of the key 54 with the cam 44 is described as follows. The projection of the key 54 is inserted into the correspondingly-shaped key hole 51. This movement aligns the key magnets 56 with the lock magnets 52. If the polarity of a given key magnet 56 is the same as that of its corresponding lock magnet 52, the key magnet 56 will exert a force against the lock magnet 52, which will in turn compress the lock spring 53, thereby removing the lock magnet 52 from within its cam aperture 45. When all key magnets 56 exert such a force against their opposite lock magnets 52, all the lock magnets 52 will be forced from their cam apertures 45, and the cam 44 will therefore be free to rotate. The technician can then apply a torque to the key 54 and cause the cam 44 to rotate. It will be appreciated that the key 54 can similarly render the cam 44 immobile if the opposing key magnets 56 and lock magnets 52 have opposite polarities, such that lock magnets 52 are drawn into the cam apertures 45 by the key magnets 56. Generally, however, this is not required because the lock magnets 52 will be biased into the cam apertures 45 by the lock springs 53.

Figure 5:
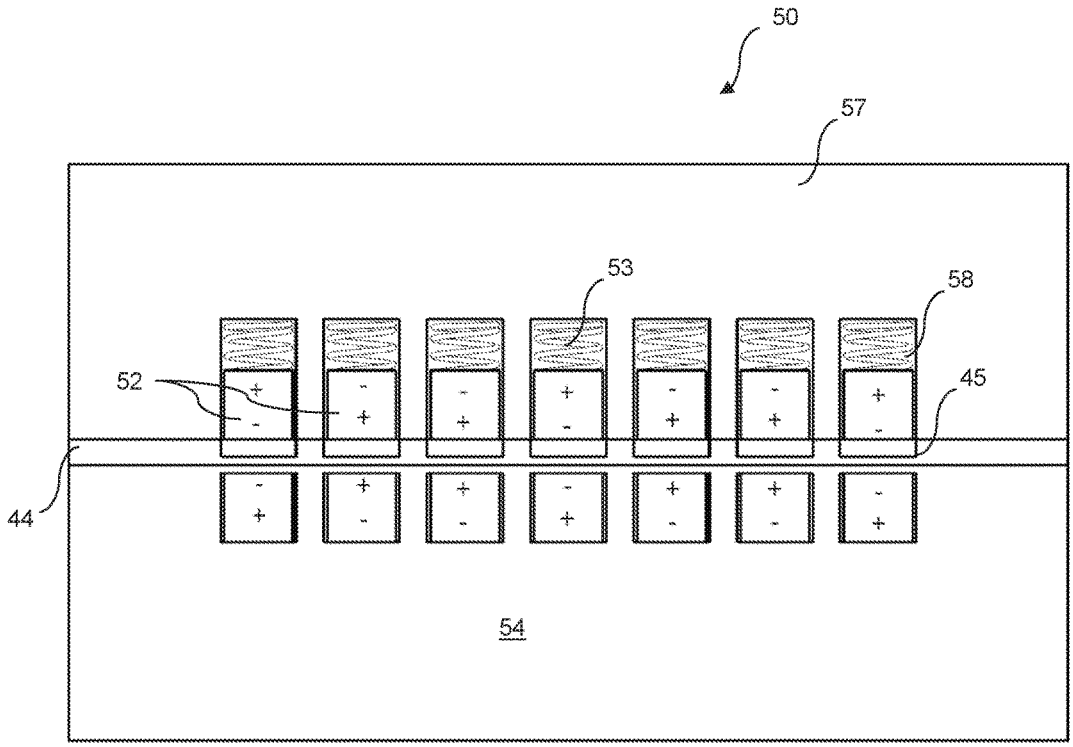
FIG. 5 is a schematic view of a lock assembly having a locking mechanism, according to yet another embodiment of the present disclosure.

The above-described engagement of the key 54 is represented schematically in FIG. 5. As can be seen, when the polarity of the circumferentially aligned key magnets 56 and lock magnets 52 is the same, the lock magnets 52 are displaced out of the cam apertures 45, against the lock springs 53, and into the lock apertures 58. The cam 44 is thus free to rotate. Similarly, when the polarity of the circumferentially aligned key magnets 56 and lock magnets 52 is not the same, the lock magnets 52 are drawn from the lock apertures 58, away from the lock springs 53, and into the cam apertures 45. It can also be appreciated that the lock magnets 52 will be biased into the cam apertures 45 by the lock springs 53 when the key magnets 56 are removed. The cam 44 is thus prevented from rotating. It can be appreciated that the use of such a locking mechanism 50 allows for many possible magnet combinations, and thus many possible codes for locking and opening the locking arm 23. For example, if eight magnet pairs are used, and each magnet has two polarities, there is a total of two hundred fifty-six possible codes.

Although magnets 52,56 are described herein as being part of the locking mechanism 50, it will be appreciated that other techniques for immobilising and mobilising the cam 44 are also within the scope of the present disclosure.

An example of the operation of the locking mechanism 50, and the resulting pivoting of the locking arm 23 between the open and locked configurations, is now further described with reference to FIGS. 7A and 7B.

Figure 7A:
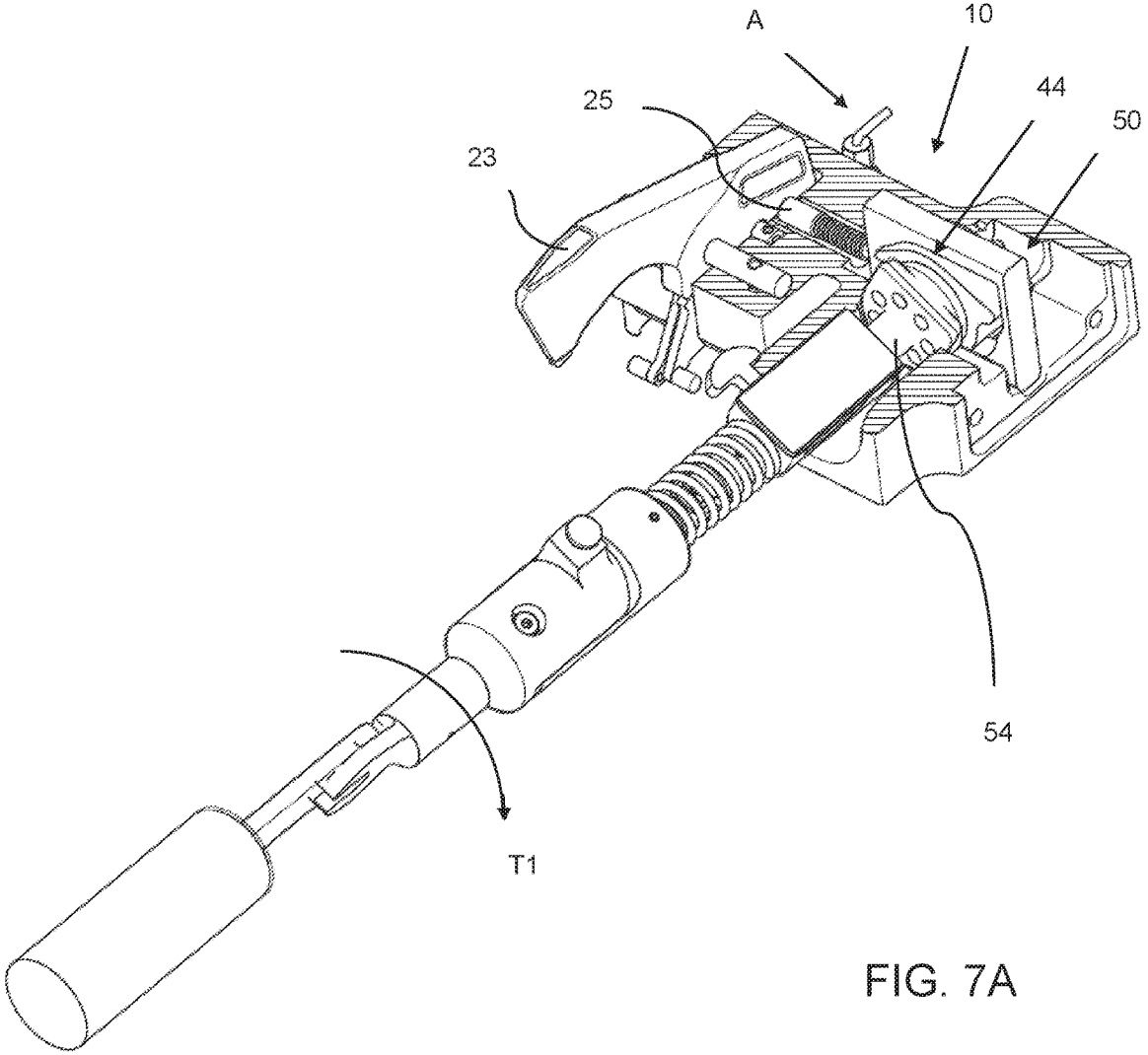
FIG. 7A is a perspective cross-sectional view of the locking system of FIG. 1A, a locking arm of the attachment assembly being shown in an open configuration.

FIG. 7A shows the transition of the locking arm 23 from the locked to the open configuration, which typically occurs when the technician wishes to install the locking system 10 onto the disconnect switch portion 62. The technician inserts the key 54 into the cam 44, such that the polarity of the lock and key magnets 52,56 are the same. This frees the cam 44, thereby allowing it to rotate. The technician then applies a torque T1 to the key 54, which causes the cam 44 to rotate and disengage the triggering mechanism 25, such that it is linearly displaced along direction A. The locking arm 23 is therefore free to pivot and can be placed in the open configuration, or allowed to bias by default into the open configuration. Optionally, and as a safety precaution, the shape of the cam 44, key 54, and/or locking mechanism 50 can be such that the key 54 cannot be withdrawn until the locking arm 23 is placed into the locked configuration.

Figure 7B:
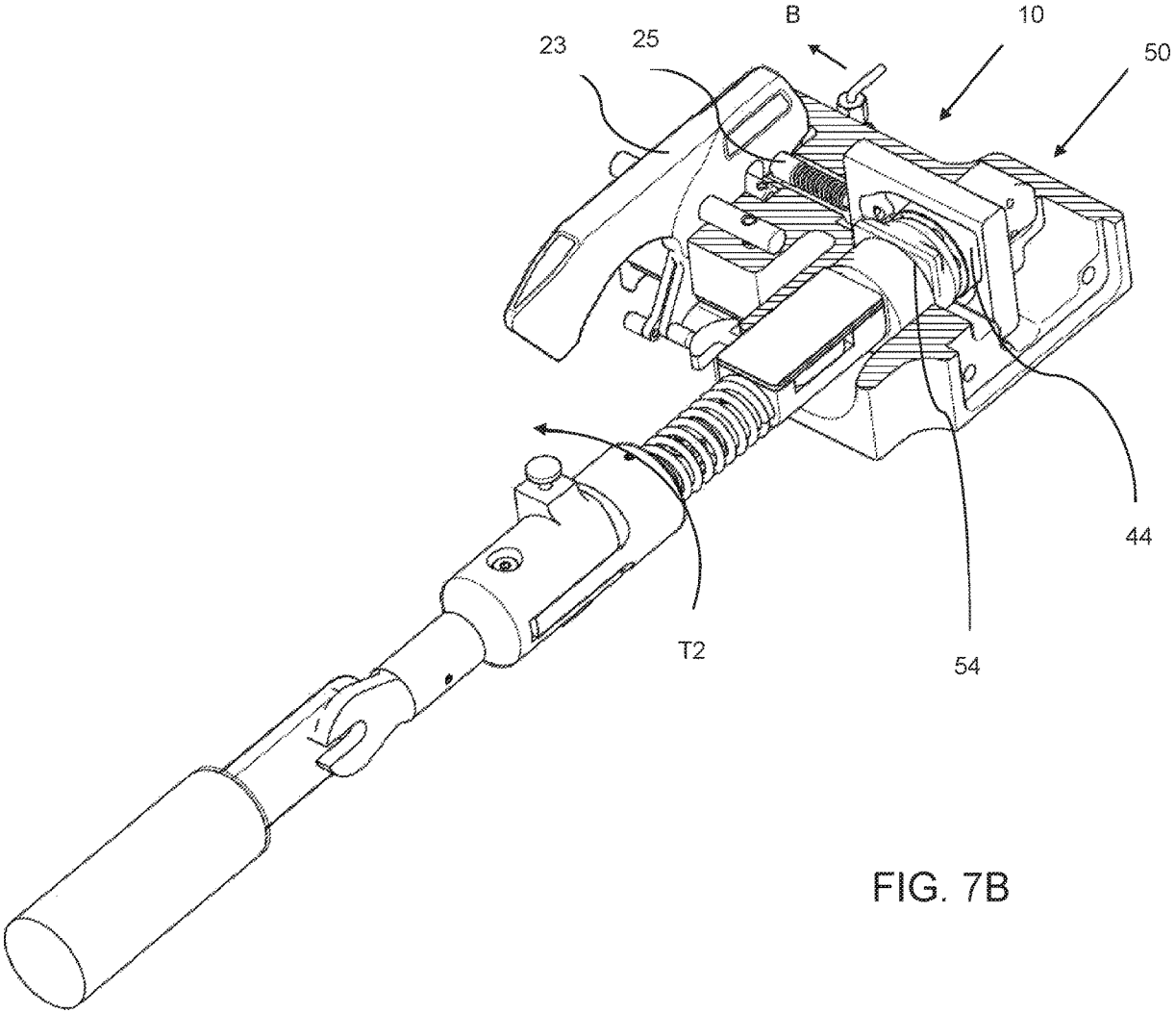
FIG. 7B is a perspective cross-sectional view of the locking system of FIG. 1A, the locking arm of the attachment assembly being shown in a locked configuration.

FIG. 7B shows the transition of the locking arm 23 from the open to the locked configuration, which typically occurs when the technician wishes to secure the locking system 10 onto the disconnect switch portion 62. The technician may reinsert the key 54 into the cam 44, although typically it is already inserted, such that the polarity of the lock and key magnets 52,56 are the same. The cam 44 is thus free to rotate. The technician then applies a torque T2 to the key 54, which causes the cam 44 to rotate and engage the triggering mechanism 25, such that it is linearly displaced along direction B. This forces the locking arm 23 to pivot toward the end 64 of the disconnect switch portion 62, or allows the technician to pivot the locking arm 23 manually. Once so pivoted into place, the locking arm 23 is prevented from pivoting again until it is unlocked or opened, and is thus fixed in the locked configuration. The key 54 may therefore be safely withdrawn.

Figure 8A:
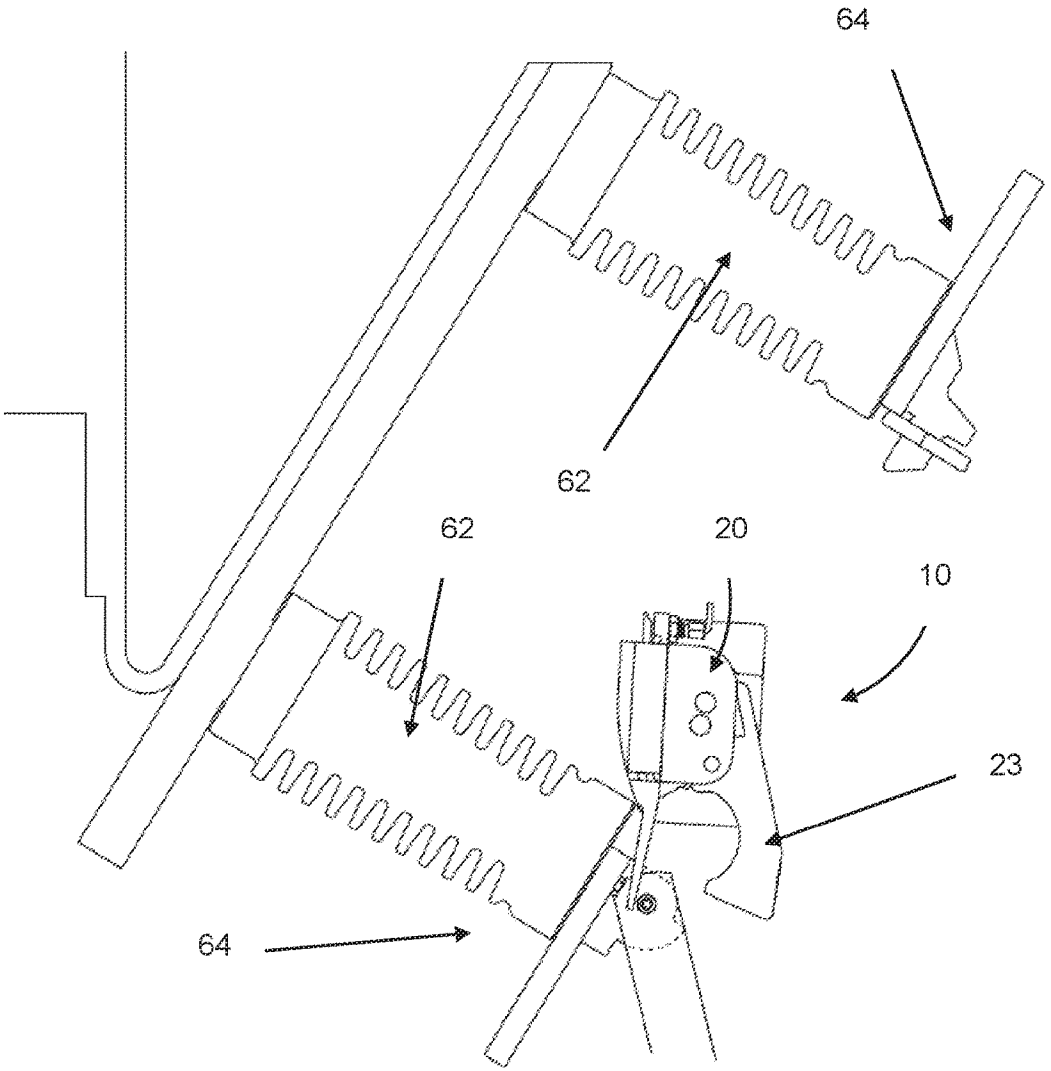
FIG. 8A is a side view of the locking system of FIG. 1A being mounted onto a disconnect switch.

An example of the mounting or installing of the lock system 10 on the end 64 of the disconnect switch portion 62 is now described with reference to FIGS. 8A to 8C. In FIG. 8A, the locking arm 23 is shown in the open configuration, and would typically be mounted to the end of a pole. The open configuration of the locking arm 23 allows the attachment assembly 20 to be lowered with the pole onto the end 64 of the disconnect switch portion 62.

Figure 8B:
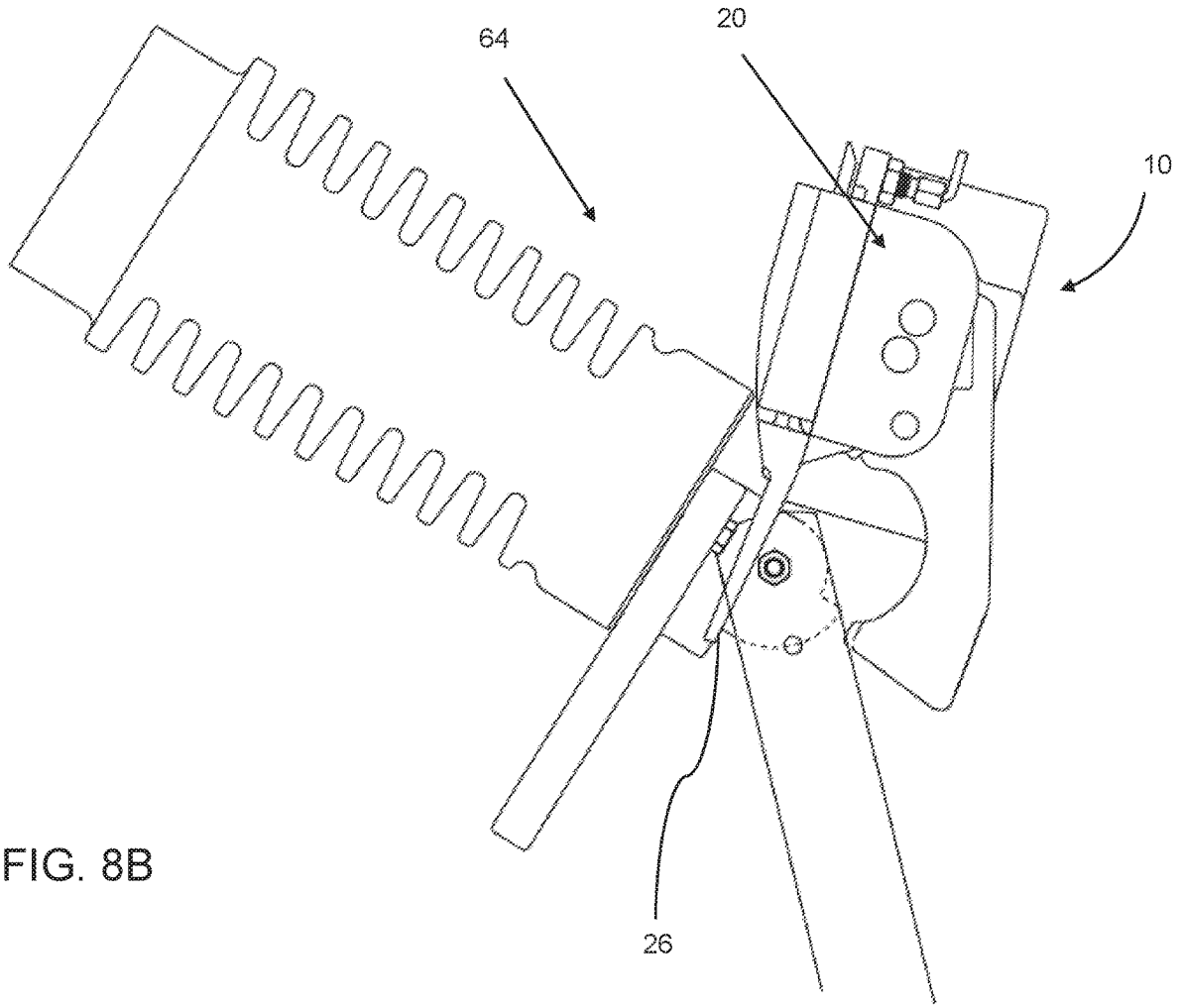
FIG. 8B is a side view of the locking system of FIG. 1A being further mounted onto the disconnect switch.
Figure 8C:
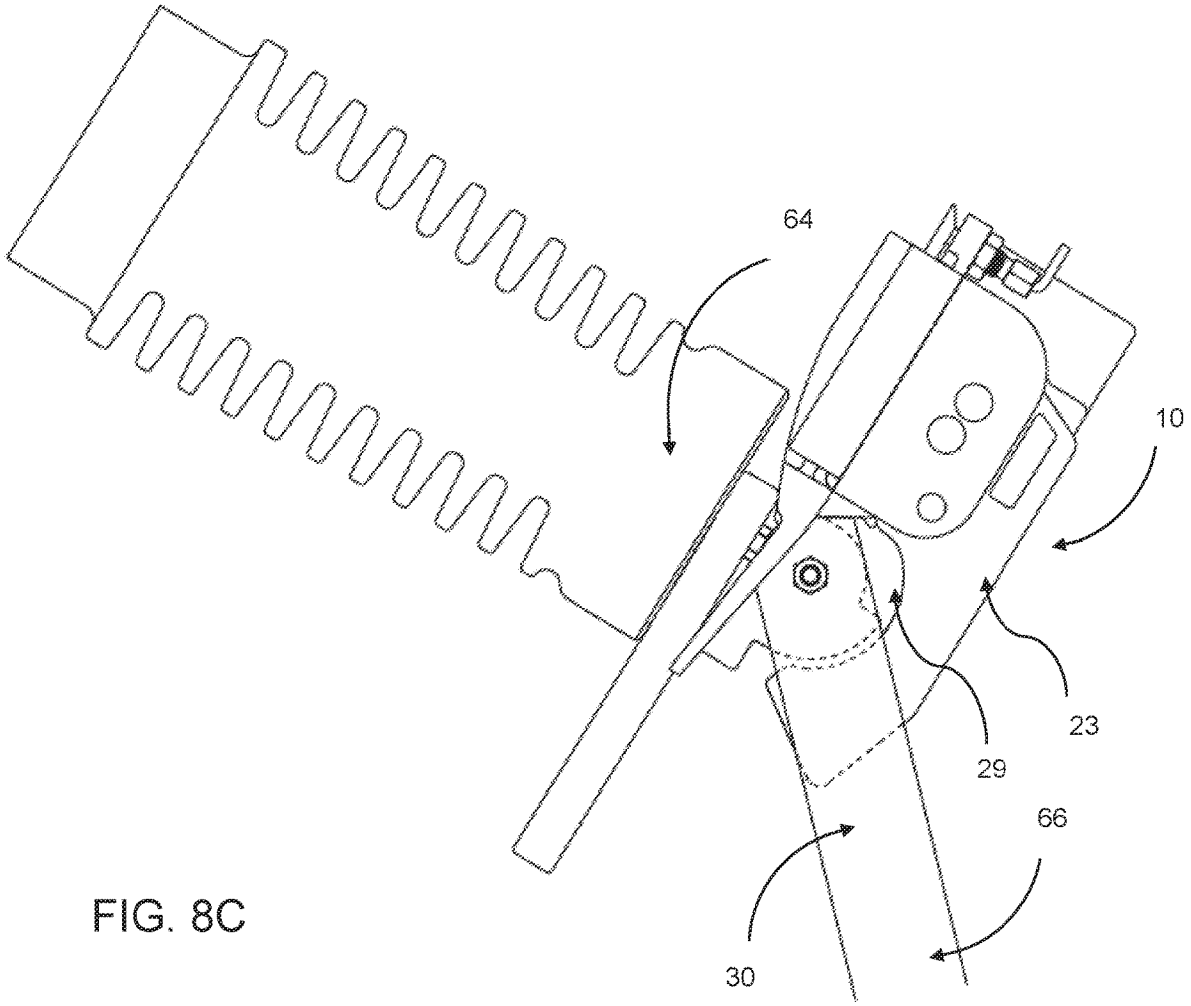
FIG. 8C is a side view of the locking system of FIG. 1A mounted onto the disconnect switch and secured thereto.

In FIG. 8B, the attachment assembly 20 is lowered further onto the end 64 of the disconnect switch portion 62 such that the end 64 is placed between the guide arms 26. In FIG. 8C, the locking arm 23 is lowered such that its mounting end 30 and arcuate receiving surface 29 encloses the end 64 of the disconnect switch portion 62. The engagement of some part of the attachment assembly with the end 64 of the disconnect switch portion 62 may cause the locking member to automatically switch into the locked configuration. As previously explained, the key 54 may be prevented from being removed from the lock assembly 40 until the locking arm 23 is in the locked configuration. This serves as a safety measure because the technician is prevented from removing the key 54, and thus the pole, from the locking system 10 until it is secured in place. Once in place, the locking arm 23 can be secured in the locked configuration, and the key 54 can be removed from the lock assembly 40. The movement of the connecting bar 66 is now restricted, and the power line cannot be re-energised.

Figure 9A:
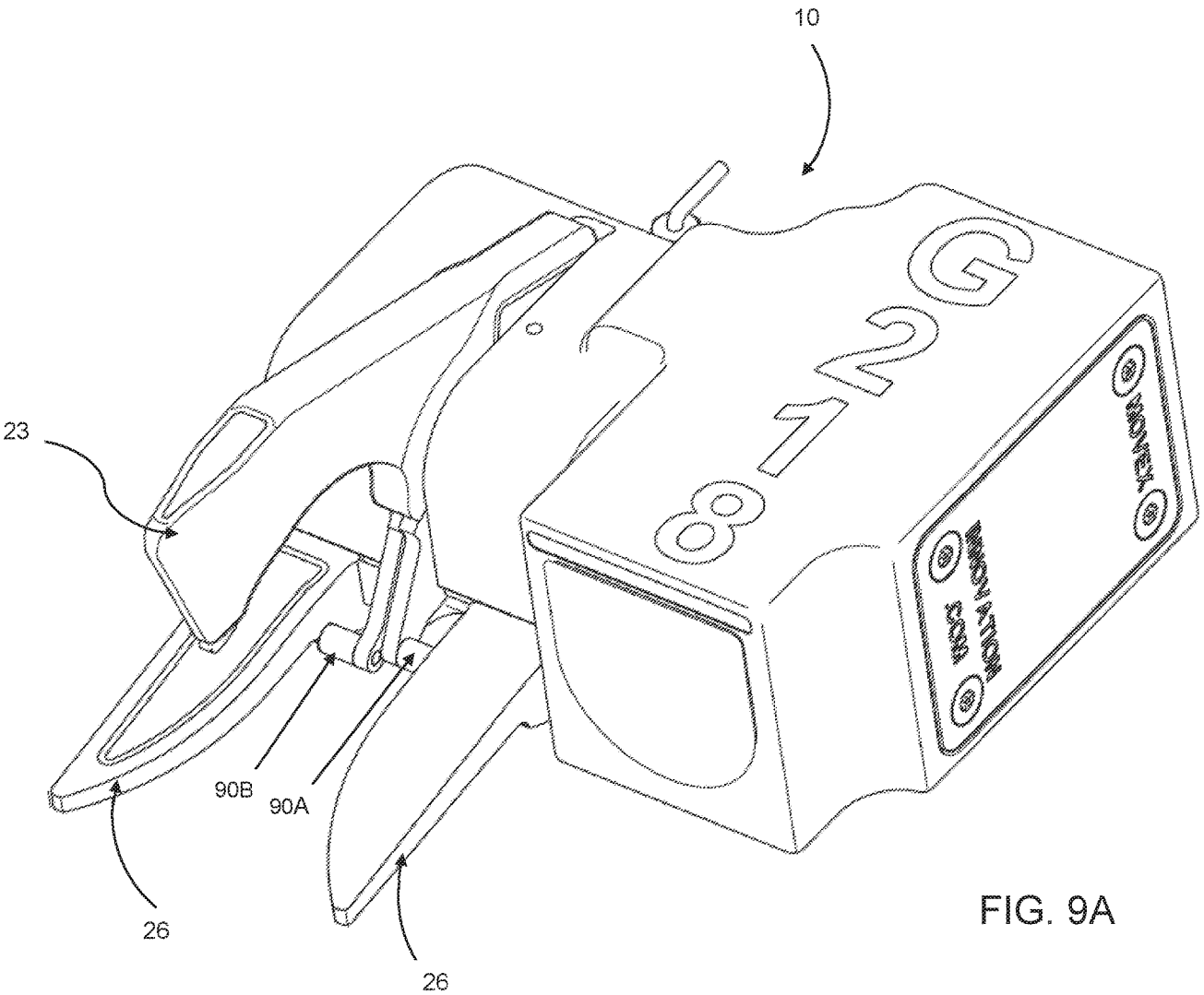
FIG. 9A is a perspective view of a locking system, according to yet another embodiment of the present disclosure, shown in an open configuration.
Figure 9B:
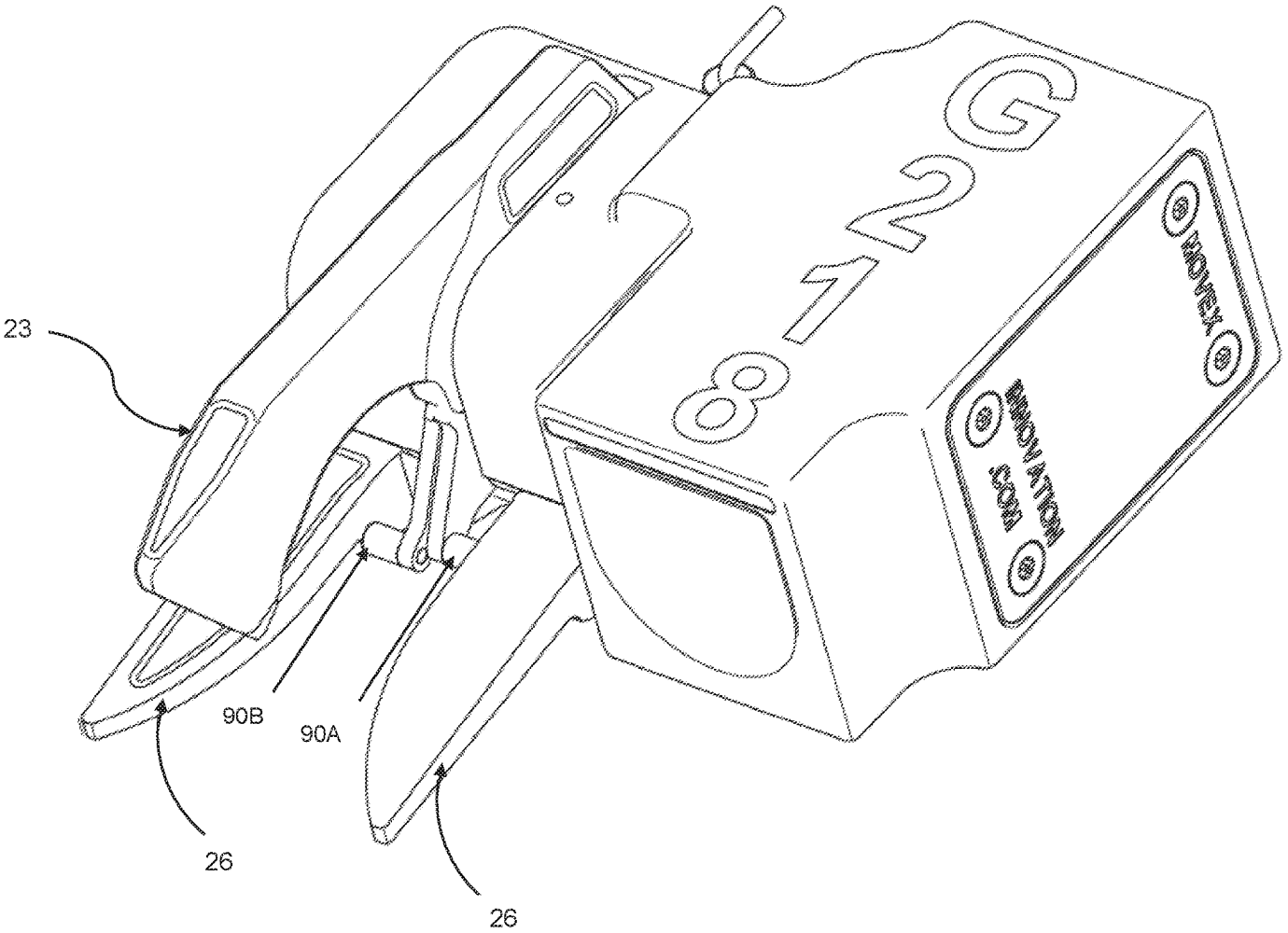
FIG. 9B is a perspective view of the locking system of FIG. 9A, shown in a closed configuration.

More specifically, referring to FIGS. 9A and 9B, the locking system 10 is shown in accordance with another embodiment. However, the locking system 10 of FIGS. 9A and 9B has many components in common with the locking system 10 of FIGS. 2A to 2C, whereby like reference numerals will refer to like components. Also, the lock assembly 40 and trigger mechanism 25 are generally the same, whereby no additional description will be provided on these components.

Figure 10A:
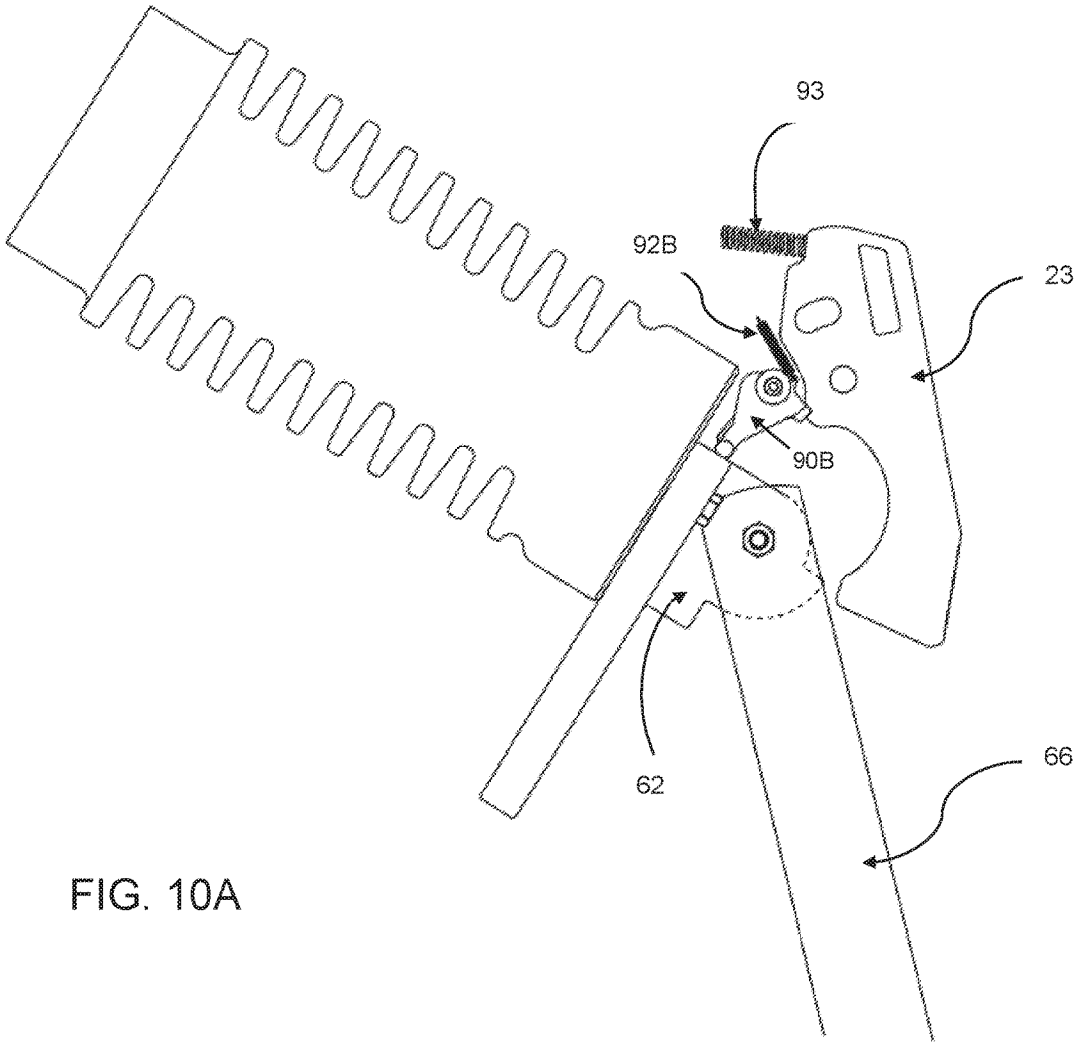
FIG. 10A is a transparent side elevational view of the locking system of FIG. 9A, with detents in blocking orientation.
Figure 10B:
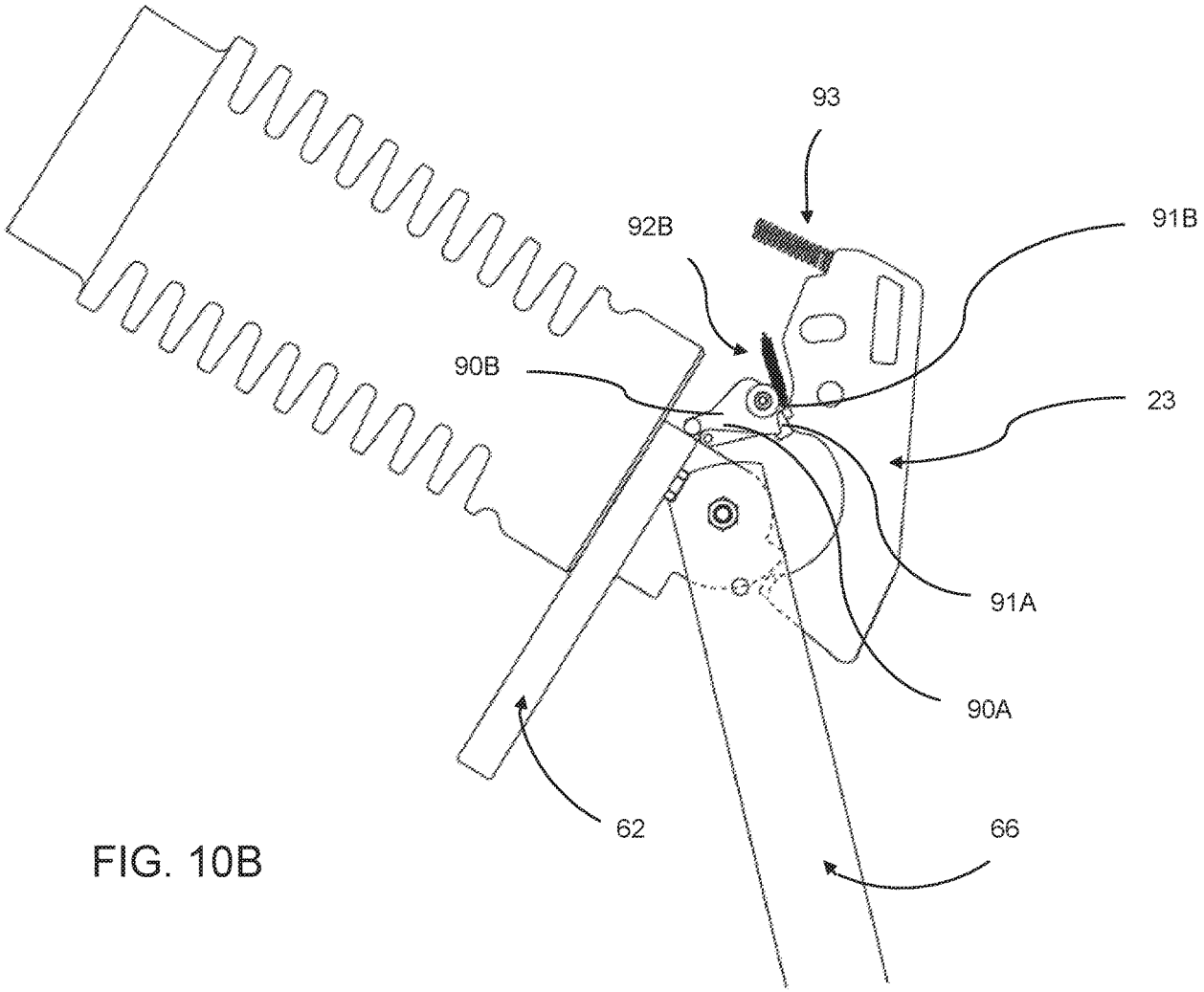
FIG. 10B is a transparent side elevational view of the locking system of FIG. 9A, a locking arm of an attachment assembly being shown in a closed configuration.

A difference resides in the detent mechanism comprising detents 90A and 90B, cooperating with abutments 91A and 91B in the locking arm 23. The detents 90A and 90B are provided to hold the locking arm 23 away from its closed configuration of FIG. 9B. The detents 90A and 90B are pivotally mounted to the body 21 and are partially in the groove 22. The locking arm 23, in this embodiment, is biased by spring 92 (any type of spring) toward the closed configuration of FIG. 9B, but prevented from doing so by abutment with the detents 90A and 90B, as shown in FIG. 10A. The detents 90A and 90B are biased by springs 93 (only one shown) to the blocking orientation of FIG. 10A. When a pressure is applied on the detents 90A and 90B, for instance when the detents 90A and 90B contact the disconnect switch portion 62/pivot of the connecting bar 66 during installation, the detents 90A and 90B move away from the blocking orientation of FIG. 10A, as shown in FIG. 10B. In doing so, the locking arm 23 is no longer prevented from rotating as pressured by the spring 92, whereby it automatically pivots to the closed configuration of FIGS. 9B and 10B. This is when the trigger mechanism 25 locks the locking arm 23, as explained above for the other embodiment.

Figure 10C:
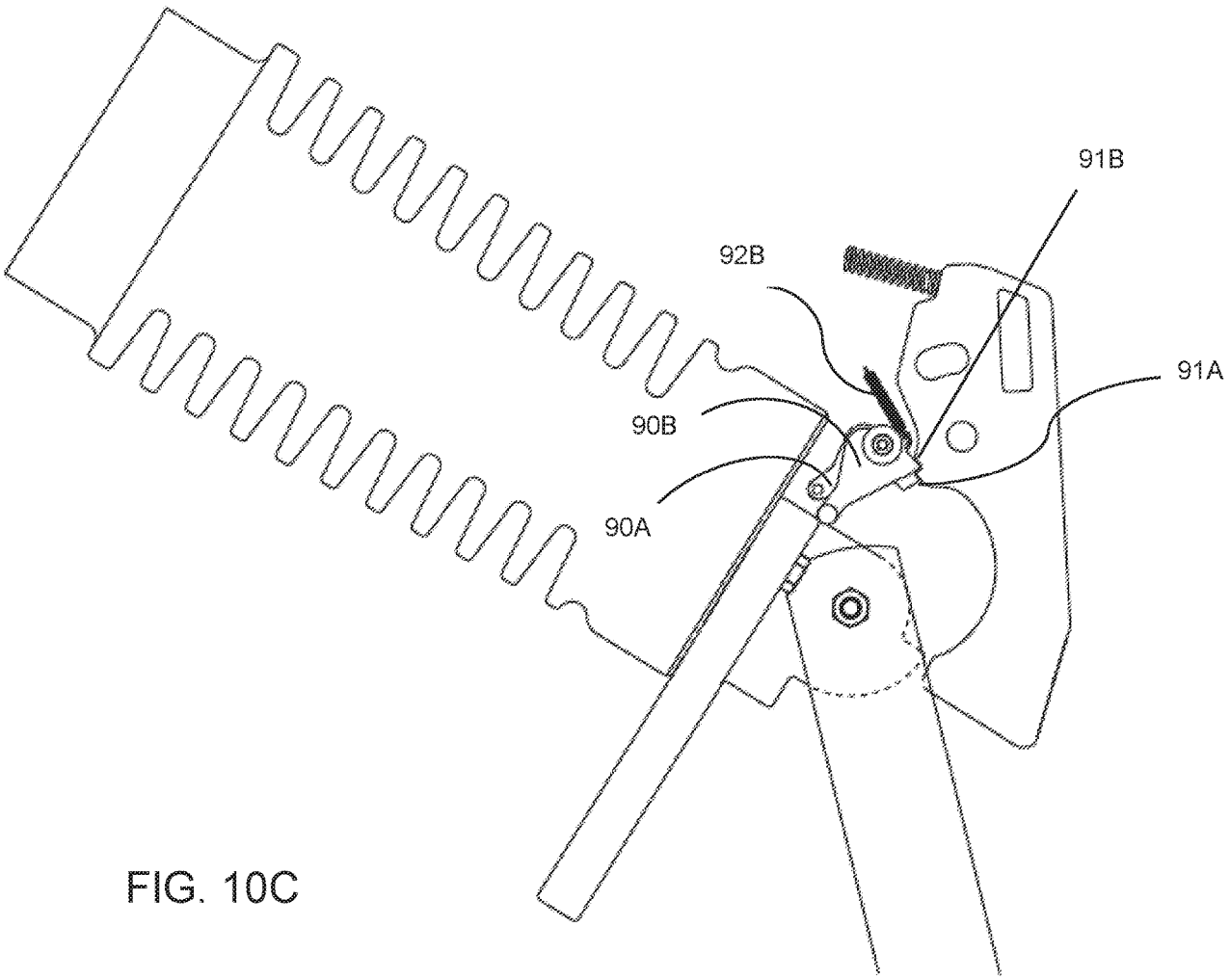
FIG. 10C is a transparent side elevational view of the locking system of FIG. 9A, with one of the detents in blocking orientation.

When removing the locking system 10 of FIGS. 9A and 9B, key 54 is used in the manner described above to temporarily release the trigger mechanism 25 from its blocking engagement in the locking arm 23. By pushing the locking system 10 out of engagement with the disconnect switch portion 62 and connecting bar 66, the locking arm 23 will pivot against the action of the spring 92. As shown in FIG. 10C, a shorter of the detents, namely 90B, is sized to squeeze back into the blocking configuration as urged by its spring 93, in spite of a small amplitude of movement of the locking arm 23. This holds the locking arm 23 away from the closed configuration, and ensures that the locking system 10 remain attached to the key 54 and pole, and thus prevent inadvertent detachment of the locking system 10 from the pole and an eventual fail to the ground. A single of the detents 90A and 90B could be provided.

Figure 11:
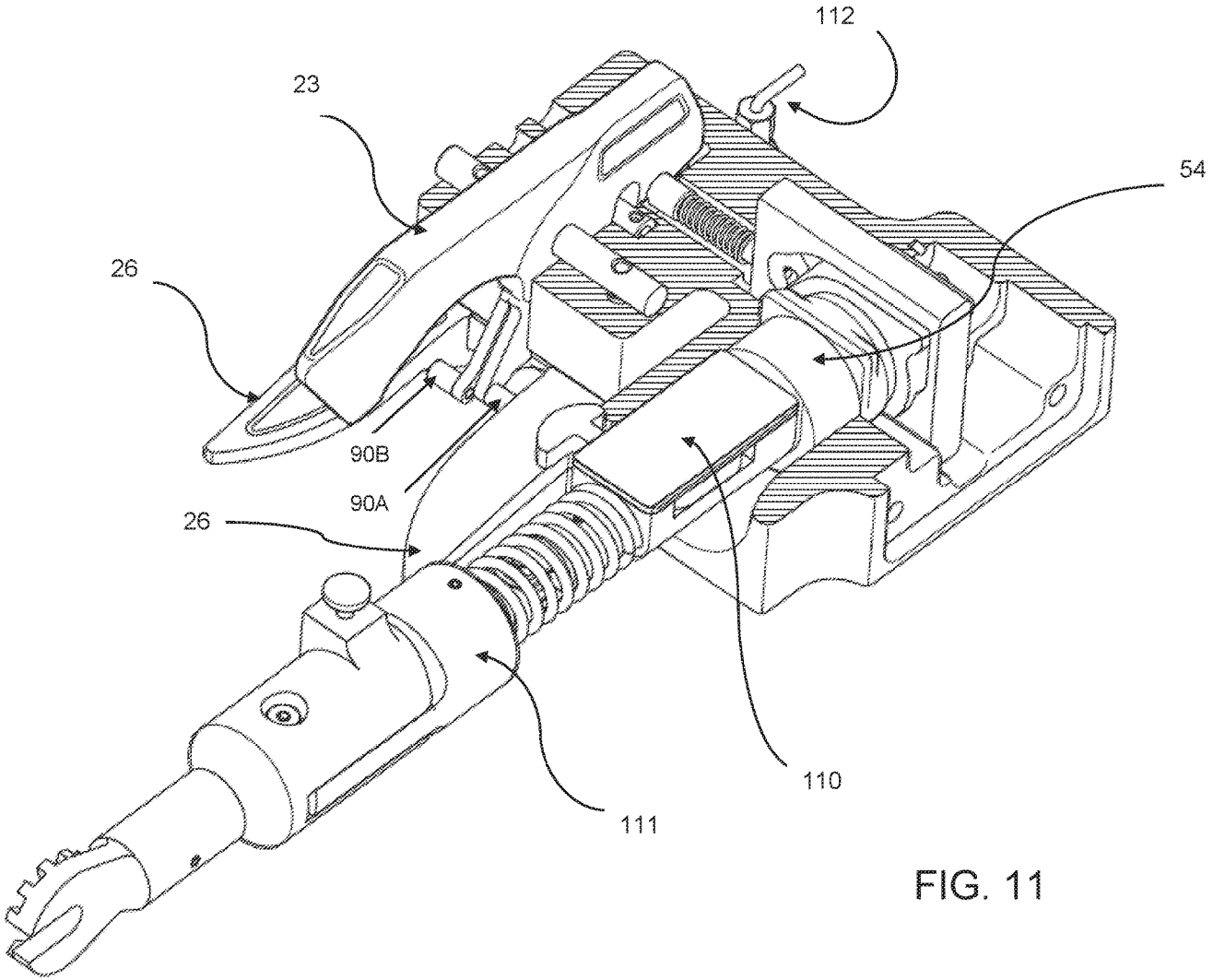
FIG. 11 is a perspective cross-sectional view of the locking system of FIG. 9A.

In FIG. 11, it is shown that a releasable attachment system 110 is provided to releasably secure the key 54 to the pole, as well as an orientation adjustment mechanism 111 to adjust an orientation of the key 54 relative to the pole. The guide arms 26 may be slid off from engagement by actuation of lock 112, to allow a selection of guide arms 26 of appropriate dimensions based on the type of power line.

In operation, the following steps may be executed. Away from the power line, the locking arm 23 must be arranged into its open configuration. To do so, the key 54 is inserted to move the trigger mechanism 25 away from engagement with the locking arm 23. At that point the key 54 is held captive and cannot be removed. The user then manually positions the detents 90A and 90B to the blocking orientation of FIG. 10A, whereby the locking mechanism 10 is armed for automatic deployment. The locking mechanism 10 is ready to be installed on the power line in the manner described above, whereby the sequence of FIGS. 10A and 10B will occur upon positioning on the power line to lock the locking system 10 in place. At that point, the key 54 will be removable from a remainder of the locking system 10.

In light of the preceding, it can be appreciated that the locking system 10 disclosed herein provides a safe, effective, and quick technique for preventing the re-energising of a power line. The locking system 10 can just as easily and quickly be removed so as to re-energise the power line.

Furthermore, the locking mechanism 50 allows for a variety of key codes to be employed, thereby ensuring that only those technicians with the correct key code can unlock the locking system 10 in order to re-energise the power line. In so doing, the locking system 10 and its alphanumeric indicator 47 provides a "lockout-tagout" system, which quickly provides a technician with information regarding when the locking system 10 was secured to the power line, for what reason, and by whom, among other possible indicators.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A locking system for a disconnect switch portion mounted to a utility pole, the locking system comprising:

an attachment assembly mountable to the disconnect switch portion, the attachment assembly having an attachment body defining a groove extending into the attachment body, a locking arm disposed within the groove and pivotable about a pivot shaft extending between opposed interior surfaces of the groove, the locking arm pivotable between an open configuration and a locked configuration, and a trigger mechanism extending through the locking arm and selectively securing the locking arm in the locked configuration; and a lock assembly mounted to the attachment assembly and having a lock body defining a central aperture for receiving a key therein, the lock assembly having a rotatable cam disposed at an end of the central aperture within the lock body, the cam being engaged by the key and rotated thereby, a rotation of the cam engaging the trigger mechanism to selectively secure the locking arm in the locked configuration.

2. The locking system of claim 1, wherein the attachment body has at least one guide arm extending between a first end connected to a side wall of the attachment body and an opposed free receiving end.

3. The locking system of claim 2, wherein the at least one guide arm includes a pair of parallel guide arms, each guide arm extending away from the body and defining a space therebetween.

4. The locking system of claim 3, wherein the receiving end of each guide arm includes an inclined portion, each inclined portion being angled away from the other inclined portion to increase the space between the receiving ends.

5. The locking system claim 2, wherein the at least one guide arm is removably connected to the attachment body.

6. The locking system of claim 1, wherein the locking arm has a mounting end engaging an end of the disconnect switch portion in the locking configuration.

7. The locking system of claim 6, wherein the mounting end has an arcuate receiving surface engaging the end of the disconnect switch portion in the locking configuration.

8. The locking system of claim 1, wherein the attachment body has a light-emitting source connected thereto.

9. The locking system of claim 1 being mounted to a mounting pole.

10. A locking system for blocking movement of a connecting bar between disconnect switch portions of a utility pole, the locking system comprising:

an attachment assembly having an attachment body mountable to a first one of the disconnect switch portions, and a locking arm connected to the attachment body by a joint so as to be displaceable relative to the attachment body between an open configuration allowing the attachment body to be mounted to an end of the first disconnect switch portion, and a locked configuration in which the attachment body is locked to the first disconnect switch portion by the locking arm, the locking arm in the locked configuration blocking movement of the connecting bar to prevent the connecting bar from contacting both of the disconnect switch portions, and a trigger mechanism automatically displacing the locking arm to the locked configuration when the attachment body is mounted to the end of the first disconnect switch portion; and a lock assembly mounted to the attachment assembly for automatically securing the locking arm in the locked configuration by a member thereof blocking movement of the locking arm relative to the attachment body when the locking arm is triggered to the locked configuration.

11. The locking system of claim 10, wherein the lock assembly has a lock body defining an aperture for receiving a key therein, the lock assembly having a rotatable cam disposed within the lock body, the cam being engaged by the key and rotated thereby, a rotation of the cam selectively displacing the locking arm to the open configuration.

12. The locking system of claim 11, wherein the lock body includes a fixed member disposed therein at an end of the aperture, the cam engaging the fixed member and being rotatable relative thereto.

13. The locking system of claim 10, wherein the attachment body has a pair of guide arms defining a space therebetween configured for receiving a portion of the connecting bar therein.

14. The locking system of claim 10, wherein the locking arm has a mounting end engaging the end of the disconnect switch portion in the locking configuration.

15. The locking system of claim 14, wherein the mounting end has an arcuate receiving surface engaging the end of the disconnect switch portion in the locking configuration.

16. The locking system of claim 10, wherein the lock assembly engages the trigger mechanism to actuate a linear displacement of the trigger mechanism away from the locking arm.

17. A method of preventing movement of a connecting bar between disconnect switch portions of a utility pole, comprising:

engaging an end of one of the disconnect switch portions of the utility pole with a locking system to block movement of the connecting bar from contacting both of the disconnect switch portions by mounting the locking system to said end with a mounting pole engaged with the locking system and preventing disengagement of the mounting pole from the locking system until the locking system is locked to the end of said disconnect switch portion;

locking the locking system to the end of said disconnect switch portion; and preventing removal of the locking system from the end of said disconnect switch portion until the locking system is unlocked.

18. The method of claim 17, wherein locking the locking system includes automatically locking the locking system upon engagement of the locking system with the end of said disconnect switch portion.

* * * * *